US007965307B2

(12) United States Patent
Murakami et al.

(10) Patent No.: US 7,965,307 B2
(45) Date of Patent: Jun. 21, 2011

(54) THERMAL HEAD AND METHOD OF MANUFACTURING THERMAL HEAD

(75) Inventors: Takaaki Murakami, Kanagawa (JP); Yasushi Hirumi, Kanagawa (JP)

(73) Assignee: Sony Corporation, Tokyo (JP)

( * ) Notice: Subject to any disclaimer, the term of this patent is extended or adjusted under 35 U.S.C. 154(b) by 725 days.

(21) Appl. No.: 11/942,461

(22) Filed: Nov. 19, 2007

(65) Prior Publication Data

US 2008/0117276 A1 May 22, 2008

(30) Foreign Application Priority Data

Nov. 20, 2006 (JP) ..... 2006-313645

(51) Int. Cl.
*B41J 2/34* (2006.01)
*B41J 2/335* (2006.01)

(52) U.S. Cl. ..... 347/202; 347/200; 347/203; 347/204; 347/205; 347/206; 347/208

(58) Field of Classification Search ..... 347/202, 347/203, 204, 206, 208
See application file for complete search history.

(56) References Cited

U.S. PATENT DOCUMENTS

| | | | | |
|---|---|---|---|---|
| 4,743,923 | A * | 5/1988 | Nishiguchi et al. | 347/202 |
| 4,973,986 | A * | 11/1990 | Narita | 347/201 |
| 5,374,946 | A * | 12/1994 | Shirakawa | 347/203 |
| 5,424,758 | A * | 6/1995 | Onishi et al. | 347/200 |
| 6,184,913 | B1 * | 2/2001 | Nagano et al. | 347/203 |
| 2001/0033320 | A1 * | 10/2001 | Sugiyama et al. | 347/206 |
| 2002/0158959 | A1 * | 10/2002 | Shirakawa et al. | 347/202 |

FOREIGN PATENT DOCUMENTS

| | | | |
|---|---|---|---|
| JP | 61-189954 | | 8/1986 |
| JP | 62-216762 | | 9/1987 |
| JP | 62-244661 | | 10/1987 |
| JP | 63-007543 | | 1/1988 |
| JP | 04-031065 | | 2/1992 |
| JP | 05-261953 | | 10/1993 |
| JP | 10-138541 | | 5/1998 |
| JP | 10-067130 | * | 10/1998 |
| JP | 10-278329 | | 10/1998 |
| JP | 11-291532 | | 10/1999 |
| JP | 2000-225722 | | 8/2000 |
| JP | 2001-301217 | | 10/2001 |
| JP | 2002-046297 | | 2/2002 |
| JP | 2002-370399 | | 12/2002 |
| JP | 2003-137675 | | 5/2003 |
| WO | 2005-120841 | A1 | 12/2005 |

OTHER PUBLICATIONS

Japanese Office Action issued on Jun. 2, 2009 in connection with JP Application No. 2006-313645. Japanese Office Action issued on Dec. 9, 2008, corresponding to JP Patent Appl. No. 2006-313645. Japanese Office Action dated Oct. 7, 2008 issued in connection with counterpart Japanese Patent Application No. 2006-313645.

* cited by examiner

*Primary Examiner* — Ryan Lepisto
(74) *Attorney, Agent, or Firm* — SNR Denton US LLP

(57) ABSTRACT

A thermal head is disclosed. The thermal head includes a heat generating element row in which plural heat generating elements are arrayed in a main scanning direction and a glaze that stores heat generated from the respective heat generating elements. The thermal head records an image on a recording medium by causing the respective heat generating elements to generate heat while conveying the recording medium in a sub-scanning direction. A plurality of the heat generating element rows are arrayed in the sub-scanning direction. The glaze includes plural convex portions arranged in the sub-scanning direction in association with the number of arrays of the heat generating element rows. The heat generating elements are arranged on upper sides of the convex portions, respectively.

12 Claims, 23 Drawing Sheets

THERMAL HEAD AND METHOD OF MANUFACTURING THERMAL HEAD

CROSS-REFERENCES TO RELATED APPLICATIONS

The present invention contains subject matter related to Japanese Patent Application JP 2006-313645 filed in the Japanese Patent Office on Nov. 20, 2006, the entire contents of which being incorporated herein by reference.

BACKGROUND OF THE INVENTION

1. Field of the Invention

The present invention relates to a thermal head that has plural heat generating elements arrayed therein in a main scanning direction and causes, while conveying a recording medium in a sub-scanning direction, the respective heat generating elements to generate heat to record an image and the like on a recording medium and a method of manufacturing the thermal head, and, more particularly to a technique adapted to obtain a high recording quality even if high-speed recording is performed.

2. Description of the Related Art

There is known a thermal printer including a thermal head that has plural heat elements (heat generating elements) arrayed therein and a platen roller provided to be opposed to the thermal head. In such a thermal printer, the thermal head is pressed against a recording medium (a recording sheet, etc.), which is conveyed onto the platen roller, via an ink ribbon to record an image and the like. When a thermosensitive recording medium is used, the ink ribbon is unnecessary.

FIG. 21 is a schematic diagram showing a main part of a general thermal printer 10 and is a diagram showing a section in a direction perpendicular to a rotating shaft 31 of a platen roller 30.

The thermal printer 10 shown in FIG. 21 includes a line-type thermal head 20 that has plural heat elements (not shown) arrayed therein in a line shape. A recording sheet 40 is held on the platen roller 30 and moved by the rotation of the platen roller 30.

A general image recorded by the thermal printer 10 has the shape of a horizontally long rectangle. Therefore, depending on a type of the thermal printer 10, a relatively short side (a direction perpendicular to the paper surface in FIG. 21) of the image is set as the length of the thermal head 20 and as the main scanning direction taking into account manufacturing cost and the like. The thermal printer 10 records the image on the recording sheet 40 while conveying the recording sheet 40 (feeding the recording sheet 40 in a right direction on the paper surface in FIG. 21) to form a relatively long side of the image, which is set as the sub-scanning direction.

The thermal head 20 is pressed against the recording sheet 40 via an ink ribbon 50 of a rolled cloth shape rolled between two ribbon cartridges 51. The thermal head 20 has a glaze 21, which is a convex portion standing in the vertical direction and extending in the main scanning direction. Plural heat elements are provided in a line shape along a top surface of the glaze 21. Therefore, during recording, the respective heat elements of the thermal head 20 press the recording sheet 40 with a high linear pressure.

When recording is actually executed, the respective heat elements are caused to generate heat in this state. Then, when the thermal printer 10 is a thermal printer of a sublimation transfer system, dye (thermofusible ink) of the ink ribbon 50 is transferred onto the recording sheet 40 in proportion to thermal energy generated by the heat elements. When the thermal printer 10 is a thermal printer of a thermofusible transfer system, pigment (thermofusible ink) of the ink ribbon 50 containing wax as a binder melts with thermal energy generated by the heat elements and adheres to be transferred onto the recording sheet 40. Therefore, one point of the thermofusible ink transferred onto the recording sheet 40 by the heat elements is formed as one dot.

To form a two-dimensional image with such a thermal head 20 of the line type, it is necessary to move the thermal head 20 and the recording sheet 40 relatively to each other. In other words, the thermal printer 10 sequentially forms dots while feeding the recording sheet 40 in the sub-scanning direction. Then, plural dots are arranged in the sub-scanning direction and changed to be continuous sets of dots one after another and a dot line is formed. Moreover, a plurality of the dot lines are formed in the main scanning direction by the plural heat elements arrayed in the main scanning direction. As a result, a two-dimensional image can be formed over the entire recording sheet 40.

As described above, the thermal printer 10 shown in FIG. 21 records an image on the recording sheet 40 by causing the respective heat elements to generate heat while feeding the recording sheet 40 in the sub-scanning direction using the thermal head 20 of the line type that has the plural heat elements arrayed therein in the main scanning direction. The resolution (the density of the dot line) of the thermal printer 10 depends on the number of heat elements arrayed in the main scanning direction of the thermal head 20.

FIG. 22 is a plan view showing a thermal head 200 in the past.

As shown in FIG. 22, in the thermal head 200, plural heat elements h (h1, h2, h3, h4, h5, h6, etc.) are arrayed in one row in the main scanning direction. A total number of the heat elements h is 2560. Therefore, the thermal head 200 can form 2560 dots per one line in the main scanning direction of the respective heat elements h. Since the resolution of the thermal head 200 is 300 DPI (dots per inch), the heat elements h are arranged side by side over 2560 dots/300 DPI=8.53 inches (216 mm).

In recent years, the thermal printer 10 (see FIG. 21) is demanded to form an image with high definition and, at the same time, at higher speed. For example, high recording speed equal to or lower than 1 microsecond per one dot is demanded of the thermal printer 10. Such improvement of recording speed, which should be called as "ultrahigh speed recording", causes a temperature rise in the thermal head 200.

The thermal head 200, which is originally a consumable product, is deteriorated more rapidly than usual because of an excessive temperature rise in the thermal head 200 and the durable life of the thermal head 200 is extremely shortened. When the heat elements h are arrayed at high density to form an image with high definition, a heat generation property of the thermal head 200 is spoiled. As a result, a trailing track is formed regardless of the finish of recording, i.e., a so-called "tailing" occurs, because of the heat stored in the thermal head 200 and a recording quality falls.

To cope with such a problem, for example, there is known a technique for arranging the heat elements h, which are arranged in one row, in two rows and using one of the rows for preheating of the recording sheet 40 (see FIG. 21) and the ink ribbon 50 (see FIG. 21) or forming dot lines, which are sets of plural dots arranged in the sub-scanning direction, in two rows to thereby prevent an excessive temperature rise in the respective heat elements h.

For example, JP-A-10-138541 (hereinafter, Patent Document 1) discloses a thermal head including a substrate, an insulating layer covering a surface of the substrate, a part of a surface of which is swelled, and a pattern of heat elements formed on the surface in the swelled portion of the insulating layer, wherein the substrate has a common electrode that projects from the surface, pierces through the swelled portion of the insulating layer and is exposed from the surface of the insulating layer to be connected to the pattern of the heat elements and divide the pattern of the heat elements into a first heat element and a second heat element on both sides of a portion of the connection.

SUMMARY OF the INVENTION

However, in the technique disclosed in Patent Document 1, the pattern of the heat elements is simply divided into the first heat element and the second heat element. Thus, to sufficiently transmit thermal energy generated by the respective heat elements, the thermal head has to cause the respective heat elements to excessively generate heat. As a result, temperature rises more than necessary.

FIG. 23 is a sectional view in the sub-scanning direction showing a thermal head 220 in the past in which heat elements are arrayed in two rows as in the technique disclosed in Patent Document 1.

As shown in FIG. 23, a first heat element h1*a* and a second heat element h1*b* are formed on the surface of a ridge portion 222 (the swelled portion in Patent Document 1) of a glaze 22*l* (the insulating layer in Patent Document 1). In the main scanning direction, heat elements h1*a*, h2*a*, and the like (heat elements h2*a* and the like are not shown) and heat elements h1*b*, h2*b*, and the like (heat elements h2*a* and the like are not shown) are arrayed.

A section of the ridge portion 222 of the glaze 22*l* is semicircular. A resistance material layer 224 and an aluminum layer 225 are formed on the surface of the ridge portion 222. The aluminum layer 225 is fragmented on the left and right of the top of the ridge portion 222. The resistance material 224 in this fragmented portion is formed as the first heat element h1*a* and the second heat element h1*b*. The aluminum layer 225 in the remaining portion is formed as respective electrodes "e". Surfaces of the first heat element h1*a*, the second heat element h1*b*, and the respective electrodes "e" are coated with a protective film 226.

The glaze 22*l* including the ridge portion 222 is used in this way to make it possible to effectively press the ink ribbon 50 (the recording sheet 40 and the platen roller 30). As described above, in the thermal printer 10 shown in FIG. 21, the thermal head 220 nips the recording sheet 40 and the ink ribbon 50 between the glaze 22*l* and the platen roller 30 shown in FIG. 23 and applies predetermined pressure and heat thereto with the first heat element h1*a* and the second heat element h1*b* to record an image and the like on the recording sheet 40. Therefore, "contact" of the first heat element h1*a* and the second heat element h1*b* with the platen roller 30 via the recording sheet 40 and the ink ribbon 50 (an angle of collision of the first heat element h1*a* and the second heat element h1*b* with the platen roller 30) is demanded to be proper. The first heat element h1*a* and the second heat element h1*b* are formed on a top surface of the ridge portion 222 to improve "contact".

However, when the first heat element h1*a* and the second heat element h1*b* are arranged on the left and right of the top of the ridge portion 222, since "contact" is deteriorated, a heat transfer rate falls. In other words, since the first heat element h1*a* and the second heat element h1*b* are arranged on both sides of the top of the ridge portion 222, although a certain degree of "contact" is obtained in both the first heat element h1*a* and the second heat element h1*b*, the "contact" is insufficient. Therefore, to perform optimum recording, it is necessary to cause the first heat element h1*a* and the second heat element h1*b* to excessively generate heat. As a result, the temperature of the thermal head 220 rises more than necessary.

Such excessive rise in the temperature of the thermal head 220 weakens the effect realized by providing the first heat element h1*a* and the second heat element h1*b*. Thus, the "contact" is insufficient for preventing the fall in a recording quality while realizing high definition and high-speed recording of a formed image. It is conceivable to shift positions of the first heat element h1*a* and the second heat element h1*b* to one side in the sub-scanning direction as a whole to arrange one of the first heat element h1*a* and the second heat element h1*b* at the top of the ridge portion 222 and secure sufficient "contact". However, this extremely deteriorates "contact" of the other heat element. Therefore, "contact" of the first heat element h1*a* and the second heat element h1*b* with the platen roller 30 is not improved (this means that "contact" is also deteriorated by occurrence of positional deviation in a manufacturing process).

Therefore, it is desirable to make it possible to prevent excessive temperature rise of a thermal head, suppress further deterioration in the thermal head, and prevent the fall in a recording quality due to occurrence of "tailing" and the like even if high definition and high-speed recording of a formed image are realized. It is also desirable to make it possible to manufacture such a thermal head.

According to an embodiment of the present invention, there is provided a thermal head including a heat generating element row in which plural heat generating elements are arrayed in a main scanning direction and a glaze that stores heat generated from the respective heat generating elements. The thermal head records an image on a recording medium by causing the respective heat generating elements to generate heat while conveying the recording medium in a sub-scanning direction. A plurality of the heat generating element rows are arrayed in the sub-scanning direction. The glaze includes plural convex portions arranged in the sub-scanning direction in association with the number of arrays of the heat generating element rows. The heat generating elements are arranged on upper sides of the convex portions, respectively.

(Action)

According to the embodiment, the glaze includes the plural convex portions arranged in the sub-scanning direction in association with the number of arrays of the heat generating elements. The heat generating elements are arranged on the upper sides of the convex portions, respectively. Therefore, "contact" of the respective heat generating elements is improved by the respective convex portions and a heat transfer rate is improved.

According to another embodiment of the present invention, there is provided a thermal head including a heat generating element row in which plural heat generating elements are arrayed in a main scanning direction and a glaze that stores heat generated from the respective heat generating elements. The thermal head records an image on a recording medium by causing the respective heat generating elements to generate heat while conveying the recording medium in a sub-scanning direction. A plurality of the heat generating element rows are arrayed in the sub-scanning direction. The glaze is partially divided in the sub-scanning direction in association with the number of arrays of the heat generating element rows. The glaze includes plural partial ridge portions of a ridge shape in sections thereof in the sub-scanning direction. The heat generating elements are arranged on upper sides of the partial ridge portions, respectively.

(Action)

According to the embodiment, the glaze is partially divided in the sub-scanning direction in association with the number of arrays of the heat generating element rows. The glaze includes the plural partial ridge portions of a ridge shape in sections thereof in the sub-scanning direction. The heat generating elements are arranged on the upper sides of the partial ridge portions, respectively. Therefore, "contact" of the respective heat generating elements is improved by the respective partial ridge portions and a heat transfer rate is improved.

According to still another embodiment of the present invention, there is provided a thermal head including a heat generating element row in which plural heat generating elements are arrayed in a main scanning direction and a glaze that stores heat generated from the respective heat generating elements. The thermal head records an image on a recording medium by causing the respective heat generating elements to generate heat while conveying the recording medium in a sub-scanning direction. A plurality of the heat generating element rows are arrayed in the sub-scanning direction. The glaze includes a ridge portion of a ridge shape in a section thereof in the sub-scanning direction and a flat portion formed at the top of the ridge portion. The heat generating elements are arranged on an upper side of the flat portion in each of the heat generating element rows.

(Action)

According to the embodiment, the glaze includes the ridge portion, the section in the sub-scanning direction of which is a ridge shape, and the flat portion formed at the top of the ridge portion. The heat generating elements are arranged on the upper side of the flat portion in each of the heat generating element rows. Therefore, "contact" of the respective heat generating elements is improved by the flat portion and a heat transfer rate is improved.

According to still another embodiment of the present invention, there is provided a thermal head including a heat generating element row in which plural heat generating elements are arrayed in a main scanning direction and a glaze that stores heat generated from the respective heat generating elements. The thermal head records an image on a recording medium by causing the respective heat generating elements to generate heat while conveying the recording medium in a sub-scanning direction. A plurality of the heat generating element rows are arrayed in the sub-scanning direction. The glaze includes plural ridge portions of a ridge shape in sections thereof in the sub-scanning direction arranged in the sub-scanning direction in association with the number of arrays of the heat generating element rows. The heat generating elements are arranged on upper sides of the ridge portions, respectively.

(Action)

According to the embodiment, the glaze includes the plural ridge portions, the sections of which in the sub-scanning direction are a ridge shape, arranged in the sub-scanning direction in association with the number of arrays of the heat generating element rows. The heat generating elements are arranged on the upper sides of the ridge portions, respectively. Therefore, "contact" of the respective heat generating elements is improved by the respective ridge portions and a heat transfer rate is improved.

According to still another embodiment of the present invention, there is provided a thermal head including a heat generating element row in which plural heat generating elements are arrayed in a main scanning direction and a glaze that stores heat generated from the respective heat generating elements. The thermal head records an image on a recording medium by causing the respective heat generating elements to generate heat while conveying the recording medium in a sub-scanning direction. A plurality of the heat generating element rows are arrayed in the sub-scanning direction. The glaze includes a flat base portion and a ridge portion of a ridge shape in a section thereof in the sub-scanning direction. The heat generating elements are separately arranged on upper sides of the base portion and the ridge portion in each of the heat generating element rows.

(Action)

According to the embodiment, the glaze includes the flat base portion and the ridge portion, the section of which in the sub-scanning direction is a ridge shape. The heat generating elements are separately arranged on the upper sides of the base portion and the ridge portion. Therefore, "contact" of the respective heat generating elements is improved by the base portion and the ridge portion and a heat transfer rate is improved.

According to still another embodiment of the present invention, there is provided a method of manufacturing a thermal head including a heat generating element row in which plural heat generating elements are arrayed in a main scanning direction and a glaze that stores heat generated from the respective heat generating elements, the thermal head recording an image on a recording medium by causing the respective heat generating elements to generate heat while conveying the recording medium in a sub-scanning direction. The method includes the steps of forming, on a substrate, the glaze having irregularities corresponding to the number of arrays of a plurality of the heat generating element rows arrayed in the sub-scanning direction, forming, on the irregularities of the glaze, the respective heat generating elements and electrodes for driving the respective heat generating elements, and coating the respective heat generating elements and the respective electrodes with a protective film.

(Action)

According to the embodiment, the method includes the steps of forming, on a substrate, the glaze having irregularities corresponding to the number of arrays of a plurality of the heat generating element rows arrayed in the sub-scanning direction, and forming, on the irregularities of the glaze, the respective heat generating elements and electrodes for driving the respective heat generating elements. Therefore, "contact" of the respective heat generating elements is improved by the irregularities of the glaze and a heat transfer rate is improved.

According to the embodiments of the present invention, "contact" of the respective heat generating elements is improved and a heat transfer rate is improved. Moreover, it is possible to manufacture a thermal head in which "contact" of the respective heat generating elements is improved and a heat transfer rate is improved. Therefore, it is possible to prevent excessive temperature rise in the thermal head even if high definition and high-speed recording of a formed image are realized. As a result, further deterioration in the thermal head is suppressed and the durable life of the thermal head is extended. Moreover, it is possible to prevent the fall in a recording quality due to occurrence of "tailing" and the like.

DESCRIPTION OF THE PREFERRED EMBODIMENTS

Embodiments of the present invention will be hereinafter explained in detail with reference to the accompanying drawings. In the embodiments, a heat element is equivalent to a heat generating element in the present invention. A heat element row is equivalent to a heat generating element row in the present invention.

Figure 1:
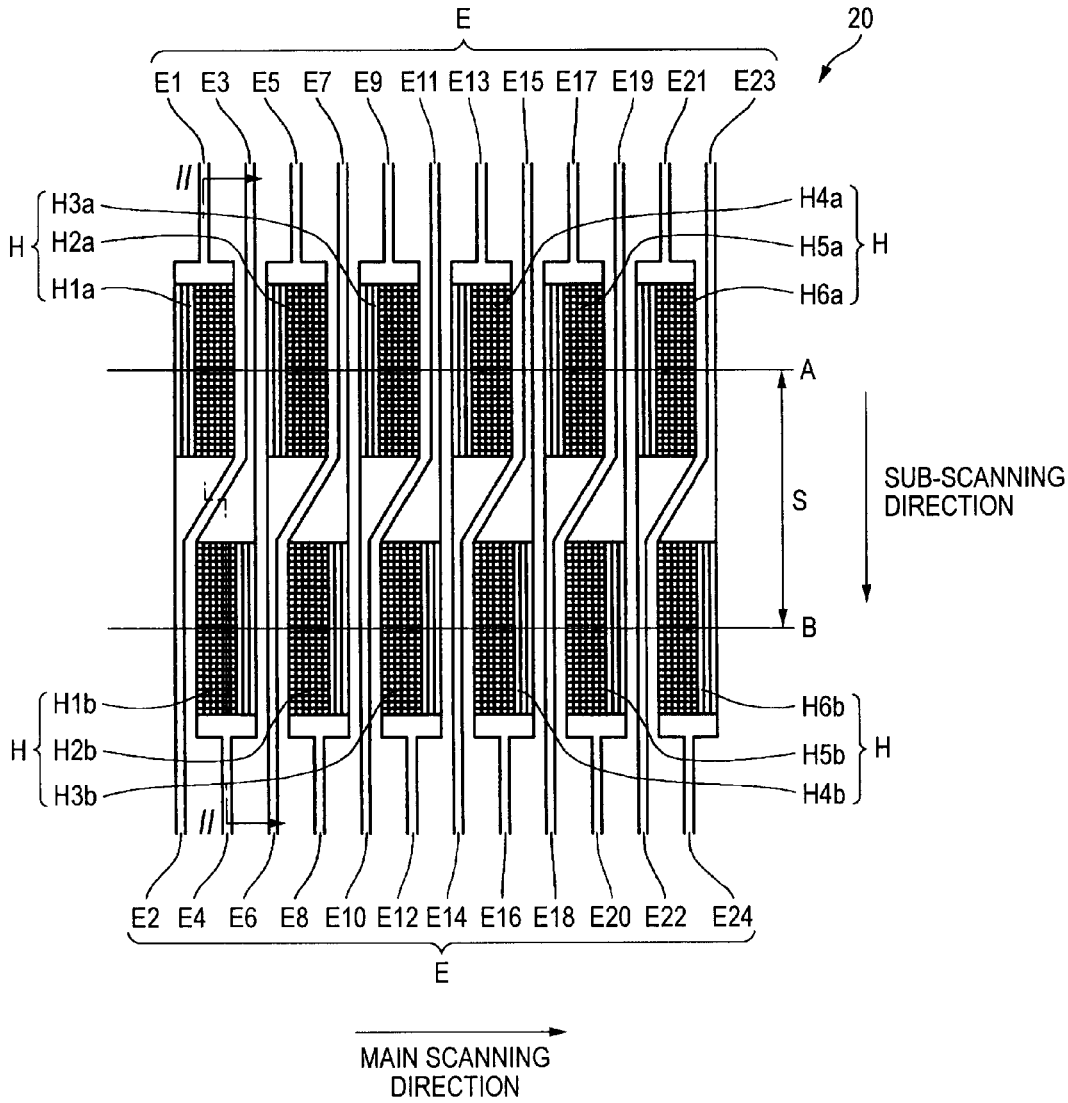
FIG. 1 is a plan view showing a thermal head according to an embodiment of the present invention.

FIG. 1 is a plan view showing a thermal head 20 according to an embodiment of the present invention common to embodiments described below.

As shown in FIG. 1, heat elements H (H1*a*, H1*b*, H2*a*, H2*b*, H3*a*, H3*b*, H4*a*, H4*b*, H5*a*, H5*b*, H6*a*, H6*b*, etc.) are arrayed in the thermal head 20. The heat elements H1*a*, H2*a*, H3*a*, H4*a*, H5*a*, H6*a*, and the like are arrayed in a main scanning direction to form a heat element row Ha. The heat elements H1*b*, H2*b*, H3*b*, H4*b*, H5*b*, H6*b*, and the like are arrayed in the main scanning direction to form a heat element row Hb. A size of the respective heat elements H is 55 μm×170 μm.

The respective heat elements H are connected to electrodes E (E1, E2, E3, E4, E5, E6, E7, E8, E9, E10, E11, E12, E13, E14, E15, E16, E17, E18, E19, E20, E21, E22, E23, E24, etc.) at both ends thereof. Pairs of heat elements H1*a* and H1*b*, H2*a* and H2*b*, H3*a* and H3*b*, H4*a* and H4*b*, H5*a* and H5*b*, H6*a* and H6*b*, and the like are connected to pairs of electrodes arrayed adjacent to each other E1 and E3 (E2 and E4), E5 and E7 (E6 and E8), E9 and E11 (E10 and E12), E13 and E15 (E14 and E16), E17 and E19 (E18 and E20), E21 and E23 (E22 and E24), and the like. The pairs of heat elements have overlapping portions (indicated by halftone dot meshing portions shown in FIG. 1) and non-overlapping portions (with respect to the main scanning direction) in a sub-scanning direction. The respective electrodes E are wired in the non-overlapping portions.

Therefore, the heat element row Ha and the heat element row Hb arrayed in two rows in the sub-scanning direction do not need extra spaces for wiring the respective electrodes E. It is possible to reduce intervals in the main scanning direction (pitches among the heat elements H1*a*, H2*a*, H3*a*, H4*a*, H5*a*, H6*a*, and the like and pitches among the heat elements H1*b*, H2*b*, H3*b*, H4*b*, H5*b*, H6*b*, and the like). Thus, the heat element row Ha and the heat element row Hb are formed with high density. In the thermal head 20 according to this embodiment, the width of the respective electrodes E and a space between the respective electrodes E and the respective heat elements H are 10 μm, respectively. The resolution of the thermal head 20 is 600 DPI. In the heat element row Ha and the heat element row Hb, 5120 heat elements H1*a*, H2*a*, H3*a*, H4*a*, H5*a*, H6*a*, and the like and 5120 heat elements H1*b*, H2*b*, H3*b*, H4*b*, H5*b*, H6*b*, and the like are arrayed, respectively.

The pairs of heat elements H1*a* and H1*b*, H2*a* and H2*b*, H3*a* and H3*b*, H4*a* and H4*b*, H5*a* and H5*b*, H6*a* and H6*b*, and the like opposed to each other between the heat element row Ha and the heat element row Hb have overlapping portions (indicated by halftone dot meshing portions shown in FIG. 1) (with respect to the main scanning direction) in the sub-scanning direction. The pairs of heat elements are arrayed not to form overlapping portions with the other heat elements H (e.g., in the case of the heat element H1*a*, with the heat elements H2*b* to H6*b* excluding the heat element H1*b*) (with respect to the main scanning direction) in the sub-scanning direction. Therefore, dot lines arranged in the main scanning direction (plural sets of dots arranged in the sub-scanning direction on a recording sheet 40 (see FIG. 21)) can be formed by the pairs of heat elements H1*a* and H1*b*, H2*a* and H2*b*, H3*a* and H3*b*, H4*a* and H4*b*, H5*a* and H5*b*, H6*a* and H6*b*, and the like opposed to each other between the heat element row Ha and the heat element row Hb. Moreover, the formation of the dots in an identical dot line (identical or different dots in the sub-scanning direction) can be shared by the heat element rows Ha and Hb.

Furthermore, the heat element row Ha and the heat element row Hb are arranged to be shifted by length S in the sub-scanning direction. Therefore, there is a space S in the sub-scanning direction between a reference line A connecting the centers (indicated by black circles) of the heat elements H1*a*, H2*a*, H3*a*, H4*a*, H5*a*, H6*a*, and the like of the heat element row Ha and a reference line B connecting the centers (indicated by black circles) of the heat elements H1*b*, H2*b*, H3*b*, H4*b*, H5*b*, H6*b*, and the like of the heat element row Hb. The space S is n (n is a natural number) times as large as a pitch of dots (hereinafter referred to as dot pitch) formed in the sub-scanning direction of the recording sheet 40 (see FIG. 21). The centers of the heat elements H indicate points where generated thermal energy is the highest.

When the space S is too large, the centers of the respective heat elements H substantially deviate from the top of a glaze 21 (see FIG. 21) and "contact" of the respective heat elements H is deteriorated and a heat transfer rate falls. The "contact" has a close relation with a diameter and rubber hardness of the platen roller 30 in use (see FIG. 21), a pressing force of the thermal head 20, and the like. In the thermal head 20 according to this embodiment, the space S is set to be three times as large as the dot pitch to secure appropriate "contact". Therefore, when the dot pitch is 85 μm, the space S is 255 μm calculated from 85 μm×n (n=3).

Figure 21:
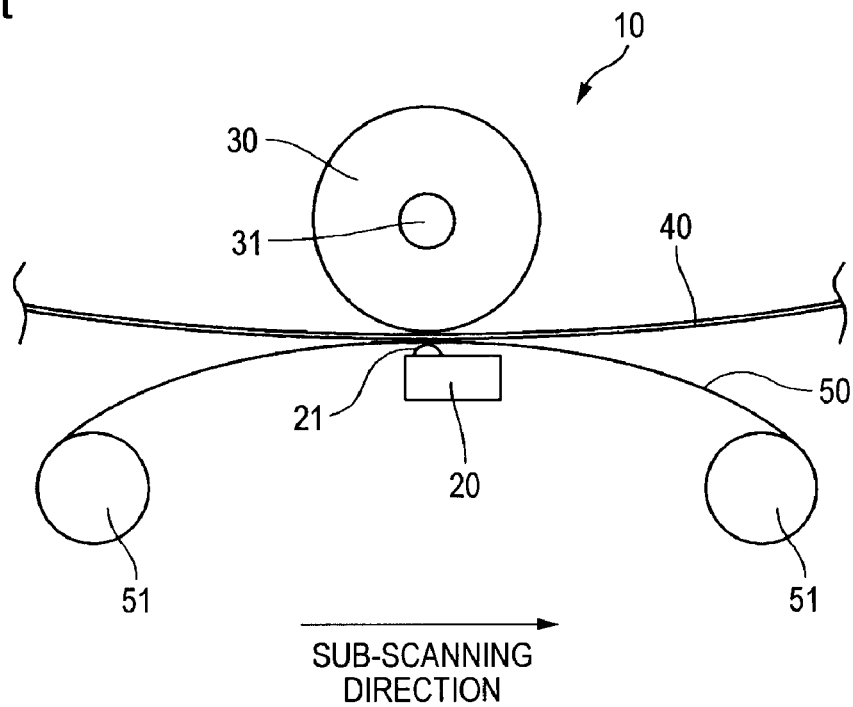
FIG. 21 Prior Art
FIG. 21 is a schematic diagram showing a main part of a general thermal printer.
Figure 22:
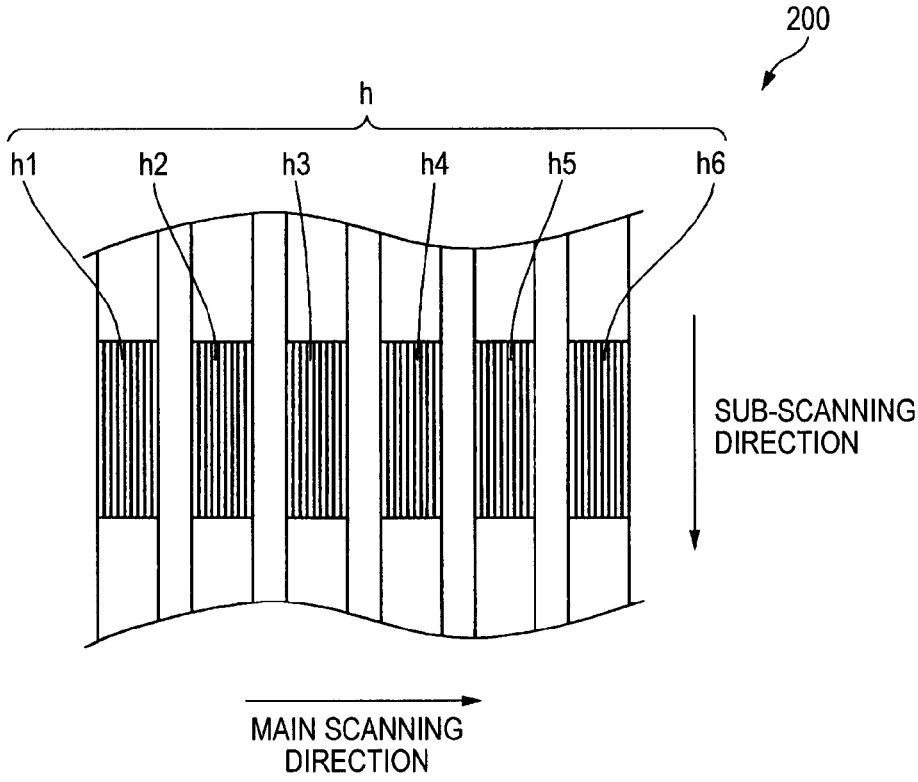
FIG. 22 Prior Art
FIG. 22 is a plan view showing a thermal head in the past.

In the thermal head 20 according to this embodiment shown in FIG. 1, "contact" of the respective heat elements H is improved and a heat transfer rate is improved by a sectional shape in the sub-scanning direction of the glaze 21 (see FIG. 21).

Thermal heads 20 including glazes 21 with improved "contact" of the respective heat elements H according to embodiments of the present invention are explained below on the basis of sectional views in the sub-scanning direction. Sections in the sub-scanning direction are sections along the sub-scanning direction of the respective heat elements H formed in the glaze 21 and are sections (C-C sections) that traverse the heat element H1*a* and the heat element H1*b* opposed to each other in the sub-scanning direction. The plan view (FIG. 1) is identical for the respective embodiments. A section in the sub-scanning direction of the glaze 21 continuously extends in an identical shape in the main scanning direction.

First Embodiment

Figure 2:
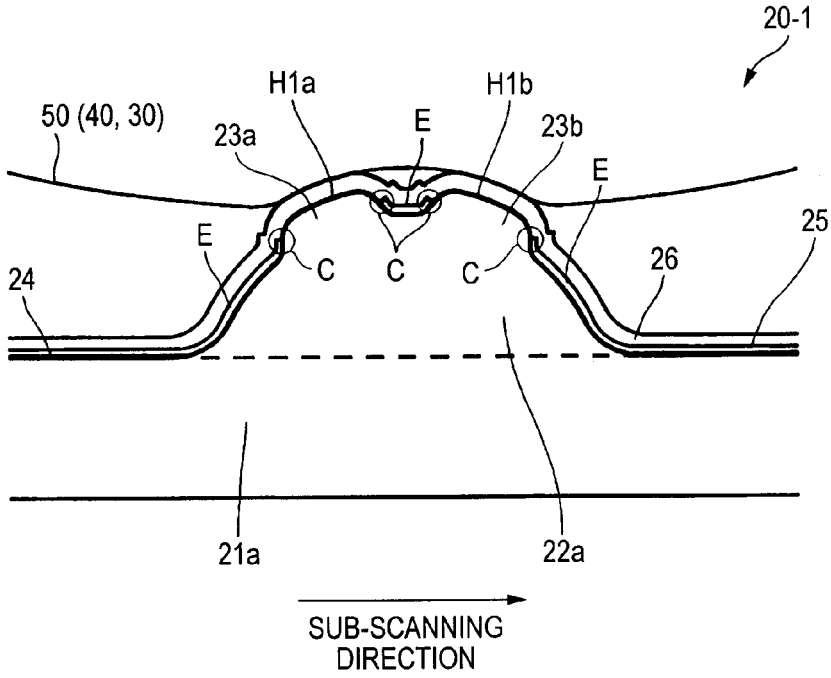
FIG. 2 is a sectional view in a sub-scanning direction showing a thermal head according to a first embodiment of the present invention.

FIG. 2 is a sectional view in the sub-scanning direction showing a thermal head 20-1 according to a first embodiment of the present invention.

As shown in FIG. 2, in the thermal head 20-1 according to the first embodiment, a glaze 21*a* made of glass is formed on a substrate of alumina ceramics (not shown). The glaze 21*a* includes a ridge portion 22*a* of a ridge shape (a semicircular shape) in a section in the sub-scanning direction. On an upper side of the ridge portion 22*a*, plural (two) convex portions 23*a* and 23*b* arranged in the sub-scanning direction in association with the number of arrays (two rows) of the heat element row Ha and the heat element row Hb (see FIG. 1) are formed.

A resistance material layer 24 and an aluminum layer 25 are sequentially stacked on upper sides of the convex portions 23*a* and 23*b* to form the heat element H1*a*, the heat element H1*b*, and the respective electrodes E. A protective film 26 is formed to cover the heat element H1*a*, the heat element H1*b*, and the respective electrodes E. The heat element H1*a*, the heat element H1*b*, and the respective electrodes E are formed as a pattern as shown in FIG. 1 in plan view.

A sectional shape in the sub-scanning direction of the ridge portion 22*a* is a semi-arcuate shape convex upward at least near a top most portion of the ridge portion 22*a* and is formed of a gentle curved line. On both sides of the top most portion of the ridge portion 22*a*, two convex portions 23*a* and 23*b* further convex upward and flat at the tops are symmetrically formed. The two heat elements H1*a* and H1*b* are arranged on upper sides of the flat tops of the convex portion 23*a* and the convex portion 23*b*, respectively. The centers in the sub-scanning direction of the heat element H1*a* and the heat element H1*b* are located in the centers of the tops of the convex portion 23*a* and the convex portion 23*b*.

The heat element H1*a* and the heat element H1*b* are connected to the electrodes E at both ends thereof. Electrode connecting portions C (indicated by white circles) opposed to each other in the sub-scanning direction of the heat element H1*a* and the heat element H1*b* are located in positions lower than highest portions of the heat element H1*a* and the heat element H1*b*. Therefore, an edge portion of the protective film 26 between the heat element H1*a* and the heat element H1*b* does not come into contact with the ink ribbon 50 (the recording sheet 40 and the platen roller 30).

Since both shoulder portions of the convex portion 23*a* and the convex portion 23*b* are formed of gentle curved lines, breakage and the like of the respective electrodes E wired to pass on the upper sides of the convex portion 23*a* and the convex portion 23*b* less easily occur. Film strain and the like in forming the protective film 26 are eased.

As described above, the thermal head 20-1 according to the first embodiment is semicircular in the section in the sub-scanning direction of the ridge portion 22*a*. The convex portion 23*a* and the convex portion 23*b* are formed on the upper side of the ridge portion 22*a*. The heat element H1*a* and the heat element H1*b* are arranged on the upper sides of the convex portion 23*a* and the convex portion 23*b*, respectively. Therefore, "contact" of the heat element H1*a* and the heat element H1*b* with the platen roller 30 is improved. Satisfactory "contact" with the recording sheet 40 and the ink ribbon 50 nipped and pressed between the heat elements H1*a* and H1*b* and the platen roller 30 is realized. As a result, even if high definition and high-speed recording of a formed image are realized, it is possible to prevent excessive temperature rise in the thermal head 20-1, suppress further deterioration in the thermal head 20-1, and prevent the fall in a recording quality due to occurrence of "tailing" or the like.

The centers in the sub-scanning direction of the heat element H1*a* and the heat element H1*b* may be set in positions shifted closer to the center between the heat elements than the centers of the tops of the convex portion 23*a* and the convex portion 23*b*. Consequently, "contact" of the heat element H1*a* and the heat element H1*b* can be further improved. However, it is preferable to set an amount of the shift in a range in which the edge portion of the protective film 26 formed on the upper side of the electrode connecting portions C does not project upward.

A method of manufacturing the thermal head 20-1 according to the first embodiment shown in FIG. 2 is explained.

Figure 3:
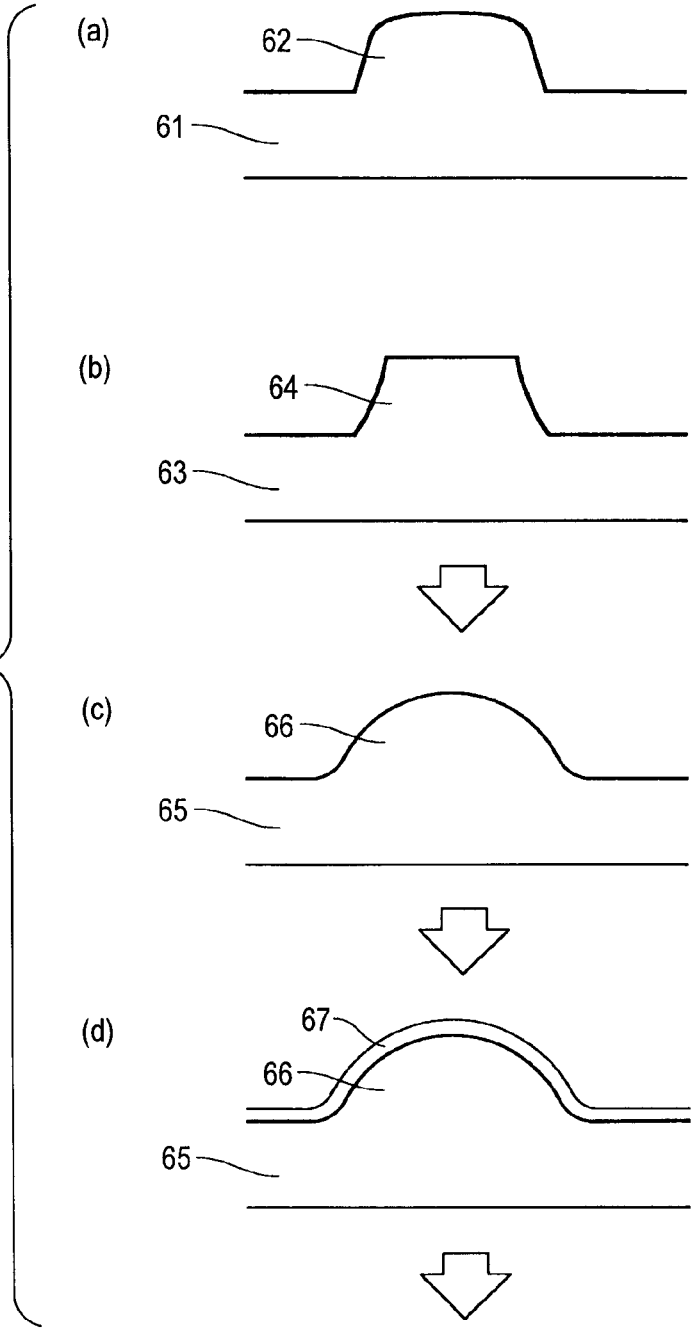
FIG. 3 shows sectional views in the sub-scanning direction showing a glaze forming process (step 1 to step 3) in a method of manufacturing the thermal head according to the first embodiment.

FIG. 3 shows sectional views in the sub-scanning direction showing a glaze forming process (step 1 to step 3) in the method of manufacturing the thermal head 20-1 according to the first embodiment shown in FIG. 2.

Figure 4:
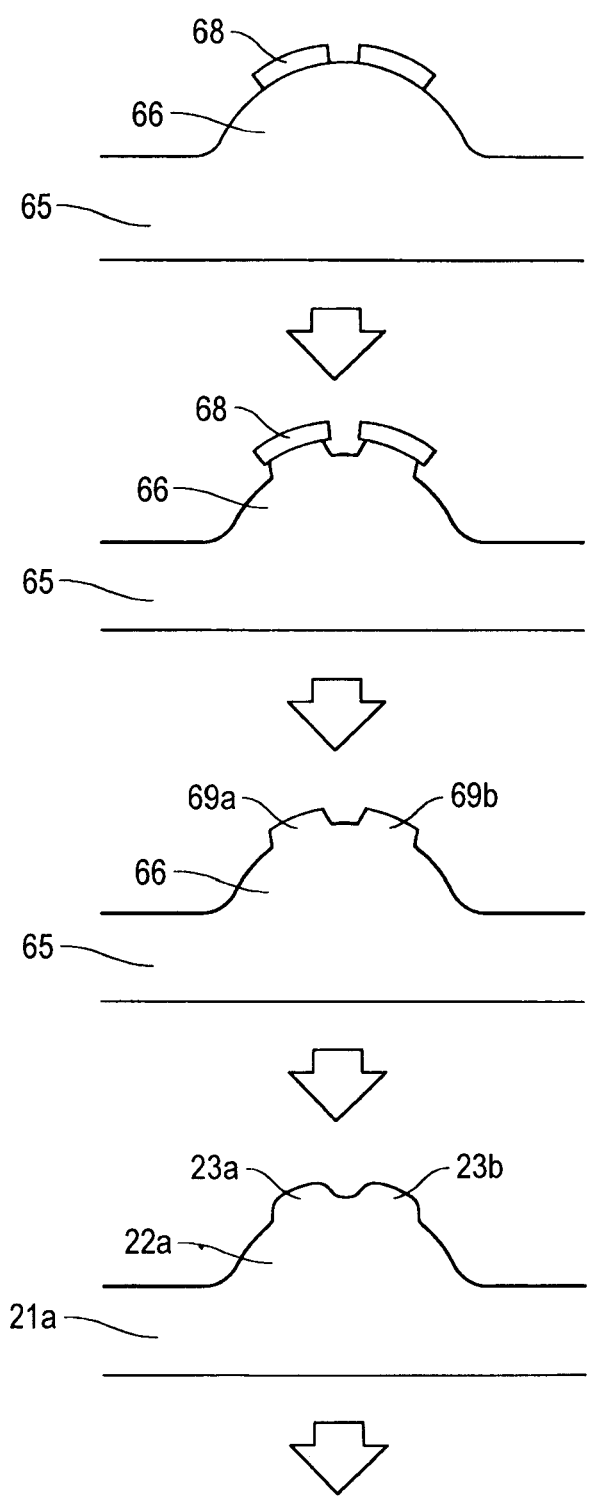
FIG. 4 shows sectional views in the sub-scanning direction showing the glaze forming process (step 4 to step 6) and a heat treatment process (step 7) following FIG. 3.

FIG. 4 shows sectional views in the sub-scanning direction showing the glaze forming process (step 4 to step 6) and a heat treatment process (step 7) following FIG. 3.

Figure 5:
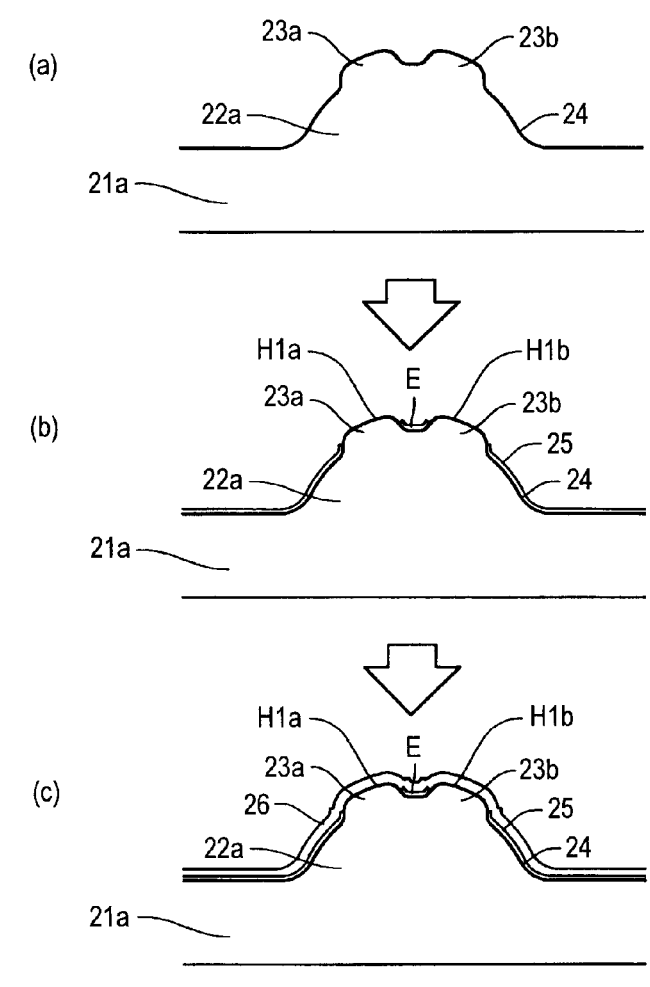
FIG. 5 shows sectional views in the sub-scanning direction showing a heat generating portion forming process (step 8 to step 10) and a protective film forming process (step 11) following FIG. 4.

FIG. 5 shows sectional views in the sub-scanning direction showing a heat generating portion forming process (step 8 to step 10) and a protective film forming process (step 11) following FIG. 4.

To manufacture the thermal head 20-1 according to the first embodiment shown in FIG. 2, first, in step 1 (a part of the glaze forming process) shown in (a) and (b) in FIG. 3, a glass paste is formed in a predetermined shape on the substrate of aluminum ceramics (not shown) or the like. Thereafter, in step 2 (a part of the glaze forming process) shown in (c) in FIG. 3, a glass flat portion 65 and a glass ridge portion 66 are formed.

In the case of step 1 shown in (a) in FIG. 3, for example, the glass paste is formed in predetermined shapes (a glass paste 61 extending in the main scanning direction in association with the glaze 21*a* (see FIG. 2) and a glass paste 62 extending in the main scanning direction in association with the ridge portion 22*a* (see FIG. 2)) according to screen printing and drying after that. Then, in step 2 shown in (c) in FIG. 3, the glass paste 61 and the glass paste 62 are baked at a temperature of about 1200° C., whereby intentional reflow is performed in addition to the baking. A rectangular pattern of the glass pastes is deformed into an R shape to form the glass ridge portion 66 and the glass flat portion 65. After continuously creating the predetermined shapes by the screen printing of the two layers in this way, it is also possible to collectively perform baking. However, when shape stability and the like during the screen printing is taken into account, it is more satisfactory to, after forming the glass paste 61 of the flat shape according to the screen printing and the drying after that, bake the glass paste 61 at a temperature of about 1200° C. to temporarily form a portion corresponding to the glass flat portion 65 shown in (c) in FIG. 3 and, then, form the glass paste 62.

On the other hand, in the case of step 1 shown in (b) in FIG. 3, the glass paste is applied to an area covering all formation areas of the glaze 21*a* (see FIG. 2) and the ridge portion 22*a* (see FIG. 2) and with thickness including both the glaze 21*a* and the ridge portion 22*a* and dried. Concerning this area, the glass paste may be applied over an entire area of a substrate (not shown) and dried. After baking the glass paste at a temperature of about 1200° C. to form flat glass, a glass rectangular shape portion 64 and a glass flat portion 63 are formed by a removing method such as etching. Thereafter, in step 2 shown in (c) in FIG. 3, a rectangular pattern of the glass paste is deformed into an R shape by performing intentional reflow by heat treatment at a temperature of about 1200° C. to form the glass ridge portion 66 and the glass flat portion 65.

In step 3 (a part of the glaze forming process) shown in (d) in FIG. 3, a resist layer 67 is formed on at least the surface of the glass flat portion 65 including the glass ridge portion 66. In step 4 (a part of the glaze forming process) shown in (a) in FIG. 4, a predetermined resist pattern 68 is formed by performing ultraviolet exposure and development using a photo-mask having a predetermined pattern corresponding to the convex portion 23*a* and the convex portion 23*b* (see FIG. 2).

Subsequently, in step 5 (a part of the glaze forming process) shown in (b) in FIG. 4, the glass flat portion 65 and the glass ridge portion 66 corresponding to an opening of the resist pattern 68 are etched to predetermined depth by, for example, wet etching using etchant containing hydrofluoric acid. Thereafter, in step 6 (a part of the glaze forming process) shown in (c) in FIG. 4, the resist pattern 68 is peeled off to obtain the glass ridge portion 66 and the glass flat portion 65 on which a convex portion 69*a* and a convex portion 69*b* having the height of about 2 to 10 μm are formed.

In this way, a basic shape of the thermal head 20-1 (see FIG. 2) is formed in the steps up to step 6 shown in (c) in FIG. 4. However, since the convex portion 69*a* and the convex portion 69*b* are patterns left as formed by etching, the patterns have edges. Therefore, in this state, it is difficult to satisfactorily form the resistance material layer 24 (see FIG. 2) and the aluminum layer 25 (see FIG. 2) on the convex portion 69*a* and the convex portion 69*b* in a post process. Therefore, in step 7 (the heat treatment process) shown in (b) in FIG. 4, all the portions are subjected to reheating treatment at a temperature of about 800 to 850° C. to round the edges of the convex portion 69*a* and the convex portion 69*b* to form the convex portion 23*a* and the convex portion 23*b*. Then, the glaze 21*a* including the ridge portion 22*a* on which the convex portion 23*a* and the convex portion 23*b* are formed is manufactured.

When the convex portion 23*a* and the convex portion 23*b* are formed by such a method, the resist layer 67 is patterned on the glass ridge portion 66. Therefore, when ultraviolet exposure is performed using the photo-mask in step 4 shown in (a) in FIG. 4, a part of an irradiated ultraviolet ray may be transmitted through the resist layer 67 to enter the glass ridge portion 66 and cause irregular reflection inside the glass ridge portion 66 or on an upper surface of the substrate of alumina ceramics (not shown) under the glass flat portion 65. Then, a rear surface of the resist layer 67, which is originally undesirable to be exposed, is exposed by the irregularly reflected ultraviolet ray. The shape of the resist pattern 68 is disordered by an influence of the exposure. In some case, it is likely that fluctuation and deficiencies occur in the shape, the dimension, the height, and the like of the convex portion 69*a* and the convex portion 69*b*.

However, in such a case, before forming the glass ridge portion 66 and the resist layer 67, a metal layer of titanium, tantalum, or the like is formed on the surfaces thereof as a light blocking layer, which blocks an ultraviolet ray, with thickness equal to or larger than about 5 to 10 nm by a method such as sputtering. This makes it possible to reduce an influence of the irregular reflection of the ultraviolet ray.

In this glaze forming process (step 2 shown in (c) in FIG. 3 to step 6 shown in (c) in FIG. 4), first, the glass ridge portion 66 is formed (step 2) and, then, a part of the glass ridge portion 66 is removed by etching or the like (step 5) to pattern the glass ridge portion 66 and the glass flat portion 65 on which the convex portion 69*a* and the convex portion 69*b* are formed. However, a method of forming a glaze is not limited to such a formation process. Any other method may be used as long as equivalent convex portion 69*a*, convex portion 69*b*, and the like can be formed.

For example, it is also possible that, after forming the glass flat portion 65 and the glass ridge portion 66, a second glass layer is formed of second glass having a softening point lower than that of first glass forming the glass flat portion 65 and the glass ridge portion 66 and removed by etching or the like to pattern the convex portion 69*a* and the convex portion 69*b*. According to this method, it is possible to lower a heating temperature of the heat treatment process (step 7 shown in (d) in FIG. 4) performed to round the edges of the convex portion 69*a* and the convex portion 69*b*. Therefore, it is possible to prevent the glass flat portion 65 and the glass ridge portion 66, which are already formed in an optimum shape, from being changed by heat treatment.

In patterning the convex portion 69*a* and the convex portion 69*b*, in the above explanation, the second glass layer is formed over substantially the entire surface of the glass flat portion 65 and the glass ridge portion 66 and, then, the convex portion 69*a* and the convex portion 69*b* are formed by removing the second glass layer. However, instead of this method, it is also possible to use a lift-off method for forming, with a resist layer or the like, a reversal pattern of a positive/negative type on the convex portion 69*a* and the convex portion 69*b* as a masking pattern and, then, forming the convex portion 69*a* and the convex portion 69*a* according to a thin film formation method well known in the past such as sputtering or CVD (Chemical Vapor Deposition) and removing the masking pattern.

As described above, the glaze 21*a* (including the ridge portion 22*a*) having irregularities (at this stage, the convex portion 69*a* and the convex portion 69*b*) is formed in the glaze formation process shown in FIG. 3 and FIG. 4 (step 1 shown in (a) or (b) in FIG. 3 to step 6 shown in (c) in FIG. 4). The irregularities (the convex portion 69*a* and the convex portion 69*b*) are made gentle to form the convex portion 23*a* and the convex portion 23*b* in the heat treatment process (step 7 shown in (d) in FIG. 4). The heat element H1*a*, the heat element H1*b*, and the respective electrodes E are formed on the irregularities (the convex portion 23*a* and the convex portion 23*b*) of the ridge portion 22*a* of the glaze 21*a* in the following heat generating portion forming process (step 8 shown in (a) in FIG. 5 to step 10 shown in (c) in FIG. 5).

In step 8 (a part of the heat generating portion forming process) shown in (a) in FIG. 5, a thin film of the resistance material layer 24 to be formed as the heat element H1*a* and the heat element H1*b* (see FIG. 2) is formed on the surface of the glaze 21*a* including the ridge portion 22*a* on which the convex portion 23*a* and the convex portion 23*b* are formed. In forming the resistance material layer 24, it is possible to use sputtering or the like.

Thereafter, the aluminum layer 25 is formed on the resistance material layer 24. For the formation of the aluminum layer 25, as in the case of the resistance material layer 24, it is possible to use sputtering or the like. Further, a photo-resist for an etching resist is formed in a portion other than the heat element H1*a* and the heat element H1*b* (see FIG. 2) using an appropriate mask according to the photolithography method used in the field of semiconductor manufacturing. Instep 9 (apart of the heat generating portion forming process) shown in (b) in FIG. 5, after the aluminum layer 25 in an opening of the photo-resist is etched using appropriate etchant, the photo-resist is peeled off. Then, the aluminum layer 25 changes to the electrodes E and the heat element H1*a* and the heat element H1*b* are arrayed between the electrodes E.

Finally, in step 10 (the protective film forming process) shown in (c) in FIG. 5, to protect the heat element H1*a*, the heat element H1*b*, and the respective electrodes E, the protective film 26 of silicon dioxide is formed on the surfaces thereof by sputtering to coat the surfaces. Consequently, the thermal head 20-1 according to the first embodiment shown in FIG. 2 is manufactured.

Second Embodiment

Figure 6:
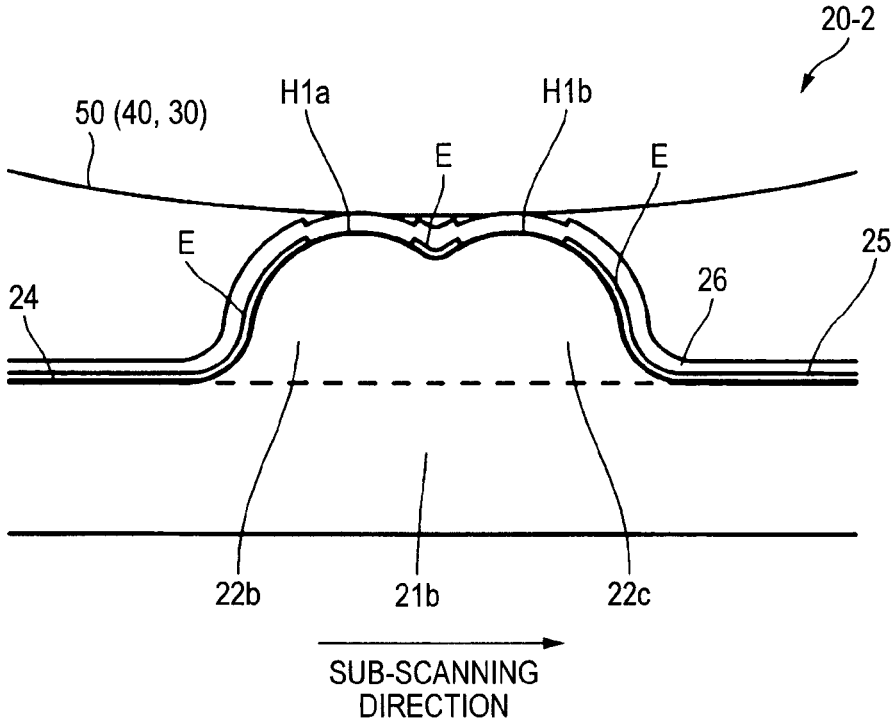
FIG. 6 is a sectional view in the sub-scanning direction showing a thermal head according to a second embodiment of the present invention.

FIG. 6 is a sectional view in the sub-scanning direction showing a thermal head 20-2 according to a second embodiment of the present invention.

As shown in FIG. 6, a glaze 21*b* in the thermal head 20-2 according to the second embodiment is partially divided in the sub-scanning direction in association with the number of arrays (two rows) of the heat element row Ha and the heat element row Hb (see FIG. 1). The glaze 21*b* includes plural (two) partial ridge portions 22*b* and 22*c* of a ridge shape in sections thereof in the sub-scanning direction. The heat element H1*a* and the heat element H1*b* are arranged on upper sides of the partial ridge portion 22*b* and the partial ridge portion 22*c*.

As described above, in the thermal head 20-2 according to the second embodiment, the glaze 21*b* is partially divided into two near the top thereof. The partially divided portions are formed in a partial two-ridge shape in which sections of two ridges in the sub-scanning direction are semicircular, respectively. In this way, the partial ridge portion 22*b* and the partial ridge portion 22*c* are formed. The heat element H1*a* and the heat element H1*b* are arranged near the respective tops of the partial ridge portion 22*b* and the partial ridge portion 22*c*. The centers in the sub-scanning direction of the heat element H1*a* and the heat element H1*b* are located at the respective tops of the partial ridge portion 22*b* and the partial ridge portion 22*c*.

Therefore, in the thermal head 20-2 according to the second embodiment shown in FIG. 6, while a pressing force on the ink ribbon 50 (the recording sheet 40 and the platen roller 30) is maintained, both the heat element H1*a* and the heat element H1*b* have center positions in the sub-scanning direction near the respective tops of the partial ridge portion 22*b* and the partial ridge portion 22*c*. Therefore, "contact" of the partial ridge portion 22*b* and the partial ridge portion 22*c* is improved.

A method of manufacturing such a thermal head 20-2 (glaze 21*b*) according to the second embodiment is explained below.

Figure 7:
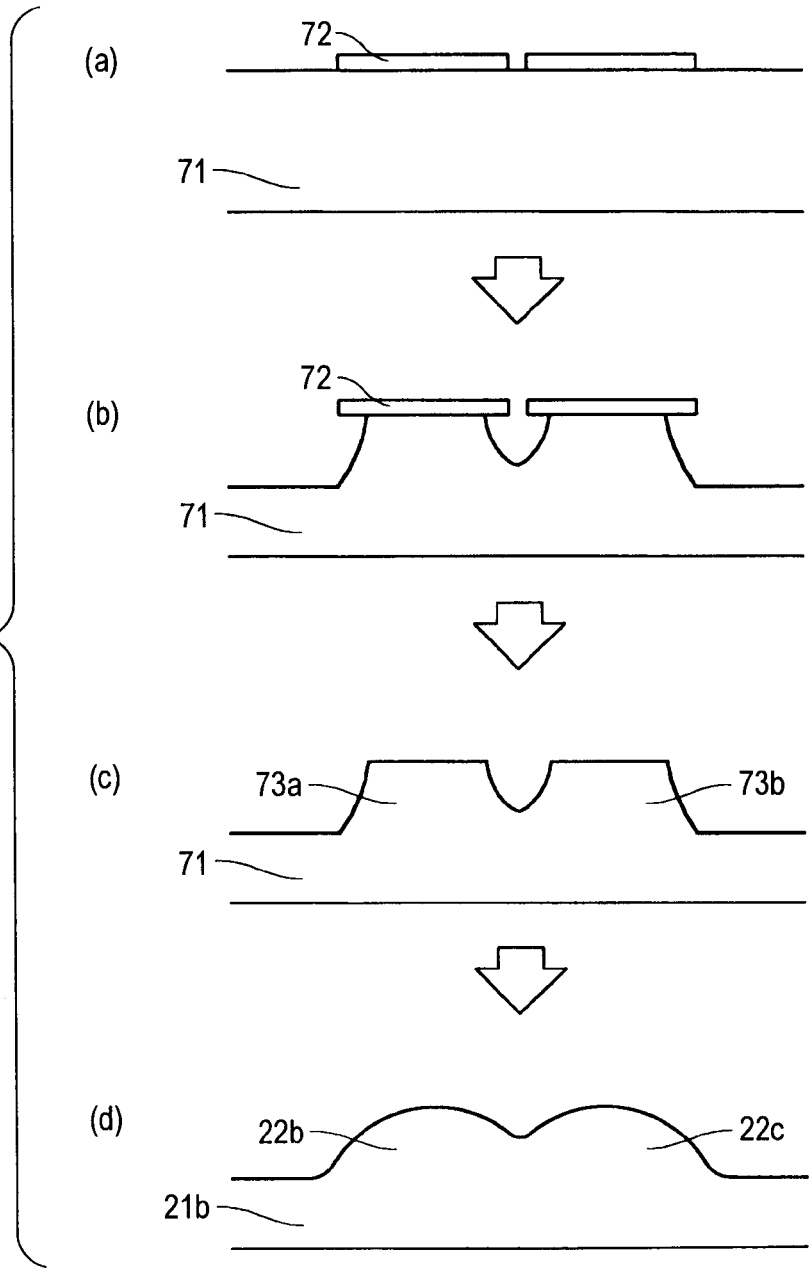
FIG. 7 shows sectional views in the sub-scanning direction showing an example of a glaze forming process (step 1 to step 4) in a method of manufacturing the thermal head according to the second embodiment.

FIG. 7 shows sectional views in the sub-scanning direction showing an example of a glaze forming process (step 1 to step 4) in the method of manufacturing the thermal head 20-2 according to the second embodiment shown in FIG. 6.

First, in step 1 shown in (a) in FIG. 7, a glass flat portion 71 is formed with substantially uniform thickness over an entire surface of a substrate of alumina ceramics or the like (not shown) or at least an area of the substrate in which the glaze 21*b* is finally formed. A predetermined resist pattern 72 corresponding to the partial ridge portion 22*b* and the partial ridge portion 22*c* is formed on the glass flat portion 71.

Subsequently, in step 2 shown in (b) in FIG. 7, the glass flat portion 71 corresponding to an opening of the resist pattern 72 is etched to predetermined depth by, for example, wet etching using etchant containing hydro fluoric acid. Thereafter, in step 3 shown in (c) in FIG. 7, the resist pattern 72 is peeled off to obtain the glass flat portion 71 including a convex portion 73*a* and a convex portion 73*b* of predetermined height. In step 4 shown in (d) in FIG. 7, a rectangular pattern of the glass flat portion 71 is deformed into an R shape by performing intentional reflow or the like by heat treatment. The glaze 21*b* is manufactured with the convex portion 73*a* and the convex portion 73*b* formed as the partial ridge portion 22*b* and the partial ridge portion 22*c*.

Figure 8:
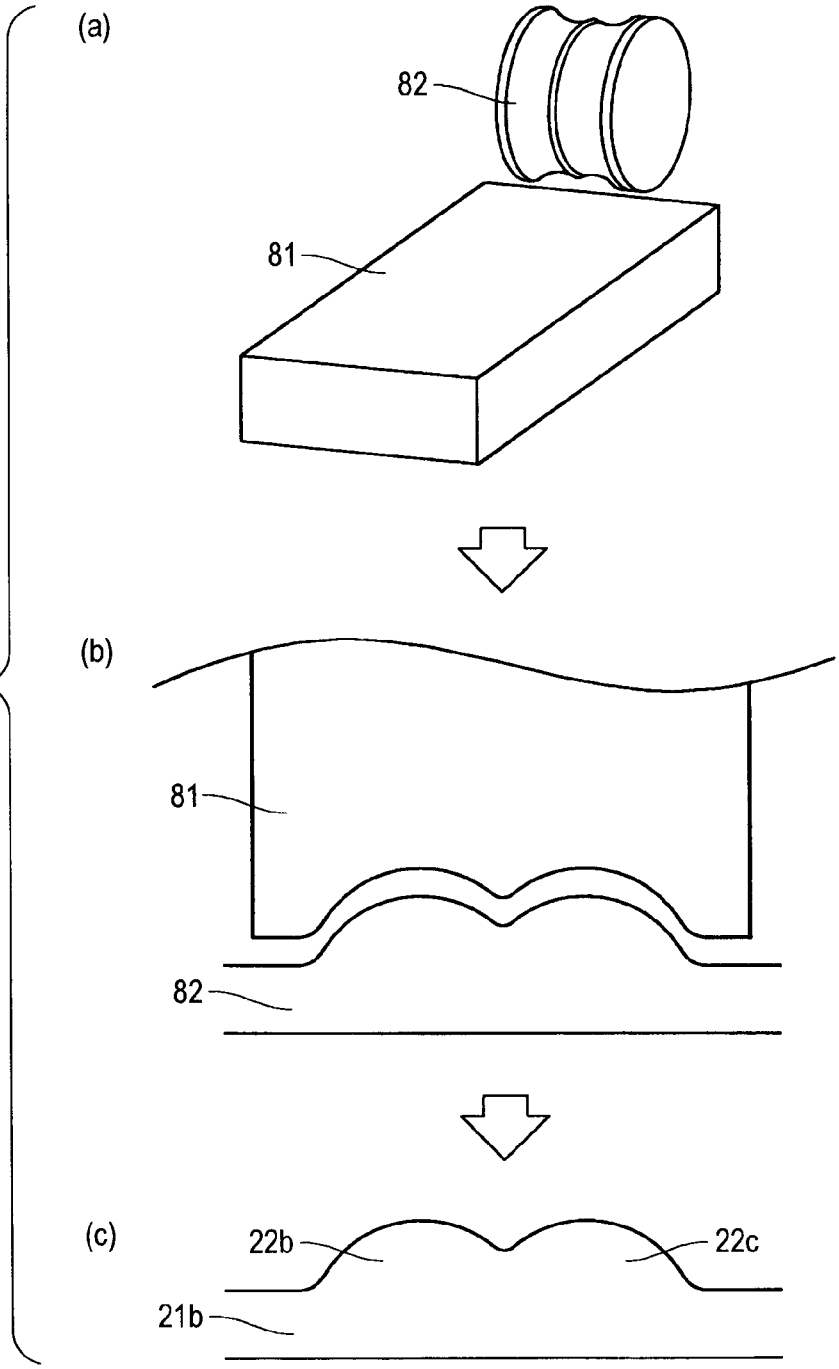
FIG. 8 shows sectional views in the sub-scanning direction showing another example of the glaze forming process (step 1 and step 2) in the method of manufacturing the thermal head according to the second embodiment.

FIG. 8 shows sectional views in the sub-scanning direction showing another example of the glaze forming process (step 1 and step 2) in the method of manufacturing the thermal head 20-2 according to the second embodiment shown in FIG. 6.

In this example, in step 1 shown in (a) in FIG. 8, a glaze glass 81 is formed with substantially uniform thickness over an entire surface of a substrate of alumina ceramics or the like (not shown) or at least an area of the substrate in which the glaze 21*b* is finally formed.

Subsequently, in step 2 shown in (b) in FIG. 8, a rotating grindstone blade 82 for machining a partial two-ridge shape to be formed as the partial ridge portion 22*b* and the partial ridge portion 22*c* is rotated to cut the glaze glass 81 to form a desired partial two-ridge shape. In other words, a shape of the rotating grindstone blade 82 corresponds to the partial two-ridge shape desired to be formed. A rotating shaft (not shown) extending in parallel to the sub-scanning direction is provided in a rotation center of the rotating grindstone blade 82. The glaze glass 81 is kept parallel to the surface of the substrate (not shown). The glaze glass 81 is set at desired height and set in a jig (not shown) having a bank portion extending parallel to the main scanning direction. While the glaze glass 81 is kept in a state of contact with the bank portion, the rotating shaft of the rotating grindstone blade 82 advances in the main scanning direction. Therefore, when the rotating grindstone blade 82 is advanced in the main scanning direction while being rotated, as shown in (c) in FIG. 8, the partial ridge portion 22*b* and the partial ridge portion 22*c* can be formed with high accuracy.

According to the method in which the rotating grindstone blade 82 shown in FIG. 8 is used, the rectangular pattern is not deformed into the R shape by performing intentional reflow by heat treatment. Thus, there is no factor of fluctuation in a shape due to a change in heat treatment conditions, a temperature distribution of the entire substrate (not shown), and the like. The partial ridge portion 22*b* and the partial ridge portion 22*c* can be stably formed. In the method in which the rotating grindstone blade 82 is used, a predetermined sectional shape can be substantially fixed along a longitudinal direction in the main scanning direction and waviness and the like in that direction can be reduced. Therefore, it is possible to apply the method to any shape other than the partial two-ridge shape.

In the cutting by the rotating grindstone blade 82, for example, a grind with hyperfine diamond particles combined on the surface thereof is used and conditions such as rotation speed and feeding speed in the main scanning direction of the grindstone during machining are optimized to prevent chipping and the like from occurring on a machined surface as much as possible.

However, fine chipping may inevitably occur partially or fine irregularities may occur on the machined surface. As described above, thin films of the resistance material layer 24 (see FIG. 6) and the aluminum layer 25 (see FIG. 6) are formed on the surface after the machining by the method such as sputtering. Thus, if the chipping or the irregularities occur more than a certain degree, breaking of wire and the like are caused. Therefore, it is desirable to perform planarization treatment after the machining.

As the planarization treatment, for example, there is a method by buffing. In the buffing, a rotator, a surface of which is made of a member for buffing, is used in the same manner as a rotating grindstone and the rotator is fed in the main scanning direction while being brought into contact with a machined surface to polish the entire machined surface. Then, the fine irregularities, chipping, and the like caused by the cutting by the rotating grindstone blade 82 are eliminated and a smoother surface is obtained. As a result, in the thermal head 20-2 according to the second embodiment shown in FIG. 6, reliability of the heat element H1*a*, the heat element H1*b*, and the respective electrodes E formed by the resistance material layer 24 and the aluminum layer 25 on the smooth surface is improved.

As another method of the planarization treatment, there is light etching (soft etching). This is a method of performing light etching using etchant that is capable of etching the glaze glass 81. As the etchant, for example, it is possible to use hydro fluoric acid water solution and the like. In the case of the planarization treatment, the density of hydro fluoric acid is set thinner than that in usual etching and etching is performed in a short time to preferentially etch fine convex portions.

Moreover, a method by heating treatment is also possible as another method of the planarization treatment. This is a method of performing heat treatment in a short time at temperature higher than a softening point of glass of the glaze glass 81. According to such heating treatment, it is possible to smooth a machined surface in the cutting by the rotating grindstone blade 82.

Third Embodiment

Figure 9:
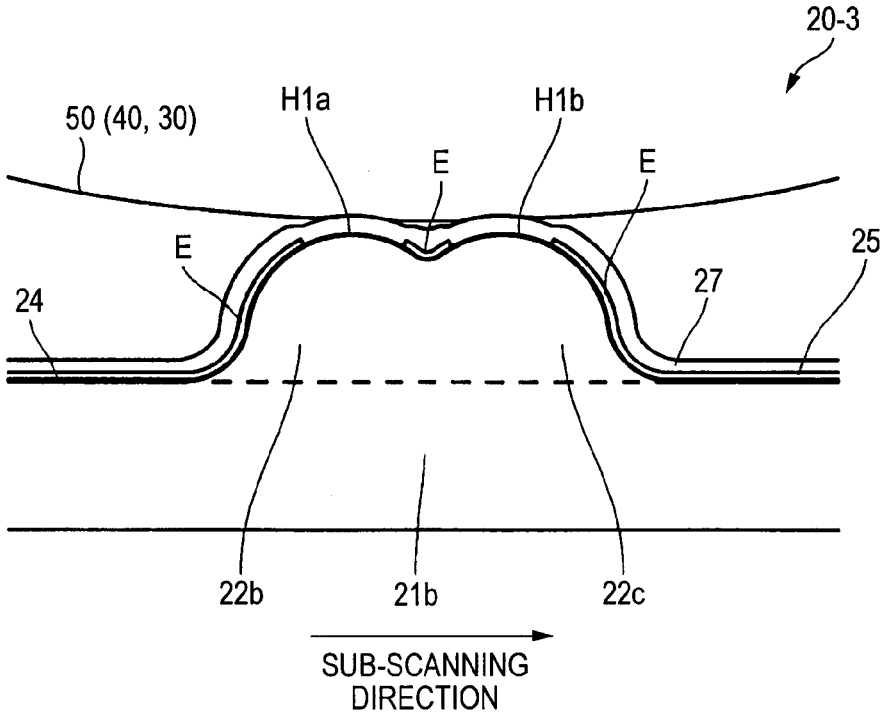
FIG. 9 is a sectional view in the sub-scanning direction showing a thermal head according to a third embodiment of the present invention.

FIG. 9 is a sectional view in the sub-scanning direction showing a thermal head 20-3 according to a third embodiment of the present invention.

As in the thermal head 20-2 according to the second embodiment shown in FIG. 6, in the thermal head 20-3 according to the third embodiment shown in FIG. 9, the heat element H1*a* and the heat element H1*b* are arranged on the upper sides of the partial ridge portion 22*b* and the partial ridge portion 22*c*, respectively. However, a step of a protective film 27 is set small.

The step of the protective film 27 is set small to eliminate a problem of "sticking" and the like. In the thermal head 20-2 according to the second embodiment shown in FIG. 6, a step due to the thickness of the aluminum layer 25 occurs on the surface of the protective film 26 (see FIG. 6). When this step is large, the ink ribbon 50 and the recording sheet 40 heated by the heat element H1*a* and the heat element H1*b* are caught on the step and conveyed while being caught. This is the problem of "sticking". In particular, when the heat element H1*a* and the heat element H1*b* are formed with high density corresponding to the resolution of 600 DPI, in addition to "contact" of the heat element H1*a* and the heat element H1*b*, the problem of "sticking" and the like due to the step of the protective film 26 more easily occurs. This problem should not be overlooked. Thus, in the thermal head 20-3 according to the third embodiment, the step of the protective film 27 is set smaller than 0.01 μm.

The step of the protective film 26 (see FIG. 6) can be made gentle by, for example, a polishing process after the protective film forming process (step 10 shown in (c) in FIG. 5). After the protective film 26 is formed, a portion having the step is removed by polishing. The polishing of the step does not always have to be performed after the protective film 26 is completely formed.

In the polishing process, after a first protective film is intentionally formed with low density by sputtering, only portions of the first protective film near the heat element H1*a* and the heat element H1*b* are selectively polished by properly using abrasives having different grain sizes to reduce the step to be smaller than 0.01 μm. When the step of the first protective film is reduced to be smaller than 0.01 μm in this way, finally, a second protective film of silicon dioxide or the like is formed on the first protective film with high density by sputtering. As a result, the thermal head 20-3 according to the third embodiment in which the protective film 27 (the first protective film+the second protective film) having the step smaller than 0.01 μm is formed is obtained. Thus, "contact" of the thermal head 20-3 in which the heat element H1*a* and the heat element H1*b* are arrayed with high density of 600 DPI is improved. It is possible to prevent the problem of "sticking" and the like.

Fourth Embodiment

Figure 10:
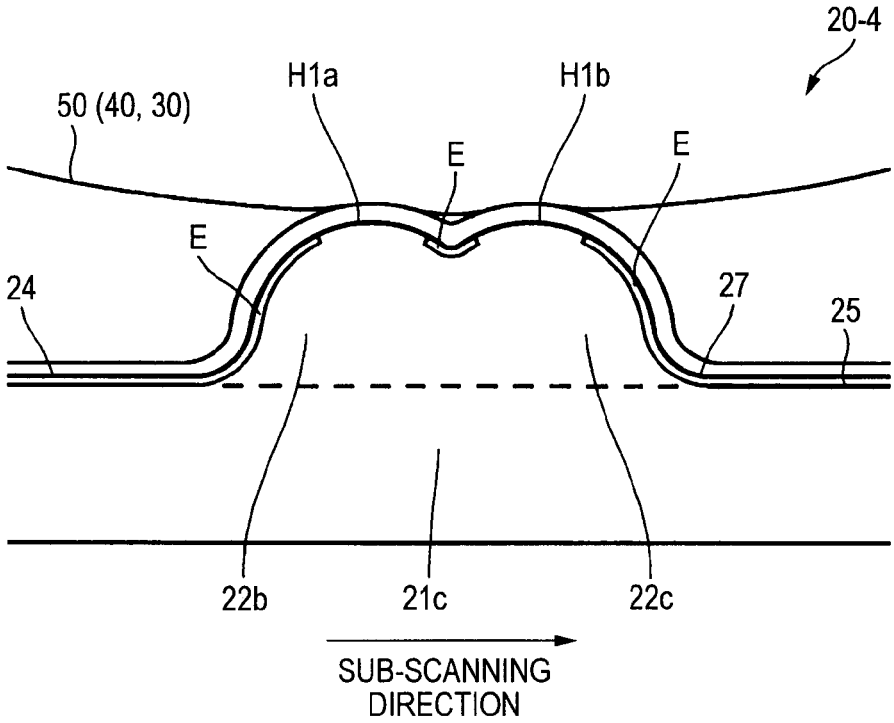
FIG. 10 is a sectional view in the sub-scanning direction showing a thermal head according to a fourth embodiment of the present invention.

FIG. 10 is a sectional view in the sub-scanning direction showing a thermal head 20-4 according to a fourth embodiment of the present invention.

As in the thermal head 20-3 according to the third embodiment shown in FIG. 9, in the thermal head 20-4 according to the fourth embodiment shown in FIG. 10, the protective film 27 with a step reduced is formed. However, a step hardly occurs because of a change in the structure of the resistance material layer 24 and the aluminum layer 25.

In the thermal head 20-4 according to the fourth embodiment, a glaze 21*c* obtained by forming the partial ridge portion 22*b* and the partial ridge portion 22*c* according to the method shown in (a) to (d) in FIG. 7 or (a) to (c) in FIG. 8 and, then, removing a part of the surfaces thereof corresponding to a wiring pattern according to the thickness of the aluminum layer 25 is used. The aluminum layer 25 is embedded in a concave portion formed by the removal and the resistance material layer 24 is formed on the aluminum layer 25. Then, compared with the thermal head 20-3 according to the third embodiment shown in FIG. 9, vertical positions of the resistance material layer 24 and the aluminum layer 25 are interchanged. An upper surface of the aluminum layer 25 embedded in the concave portion is set to be at the same level as the surfaces of the partial ridge portion 22*b* and the partial ridge portion 22*c*.

By embedding the aluminum layer 25 in the partial ridge portion 22*b* and the partial ridge portion 22*c* in this way, the projection of the aluminum layer 25, which is a main cause of occurrence of the step of the protective film 27, is eliminated. In this case, a step due to the thickness of the resistance material layer 24 formed on the aluminum layer 25 occurs. However, since the thickness of the resistance material layer 24 is usually about 0.1 μm, a step that occurs in the protective layer 27 is the same size. This is extremely small compared with a step due to the aluminum layer 25 having the thickness of about 1 μm. Therefore, an influence of the step is negligible or, even if there is an influence of the step, the influence is extremely small.

An area in which the glaze 21*c* is embedded only has to be at least a connecting portion (a portion where a step occurs) of the respective electrodes E formed by the aluminum layer 25. The elimination of the step of the protective film 27 is explained above citing the thermal head 20-3 according to the third embodiment (see FIG. 9) and the thermal head 20-4 according to the fourth embodiment (see FIG. 10) including the partial ridge portion 22*b* and the partial ridge portion 22*c* as examples. However, the method and the structure for eliminating a step can also be applied to the thermal head 20-1 according to the first embodiment including the ridge portion 22*a* shown in FIG. 2.

In the case of the thermal head 20-1 according to the first embodiment shown in FIG. 2, the electrode connecting portions C opposed to each other in the sub-scanning direction are located in the positions lower than the highest portions of the heat element H1*a* and the heat element H1*b*. Therefore, the edge portion (the step) of the protective film 26 (see FIG. 2) between the heat element H1*a* and the heat element H1*b* does not come into contact with the ink ribbon 50 (the recording sheet 40 and the platen roller 30). It is considered to be unnecessary to remove the step of the protective film 26.

However, the step of the protective film 26 may inevitably occur in an upper part or an inclined portion of the convex portion 23*a* or the convex portion 23*b* shown in FIG. 2 when the space between the heat element H1*a* and the heat element H1*b* is reduced or because of, for example, design of the length in the sub-scanning direction of the heat element H1*a* or the heat element H1*b*. Therefore, in such a case, since it is necessary to eliminate the step, it is also effective in the thermal head 20-1 according to the first embodiment (see FIG. 2) to adopt the method and the structure explained concerning the thermal head 20-3 according to the third embodiment (see FIG. 9) or the thermal head 20-4 according to the fourth embodiment (see FIG. 10).

Fifth Embodiment

Figure 11:
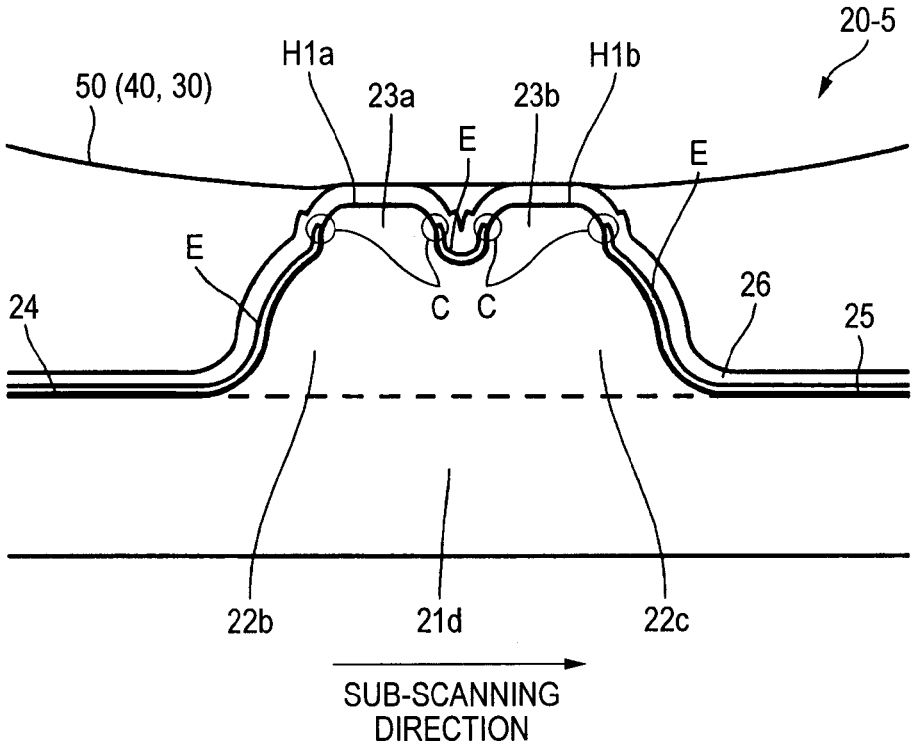
FIG. 11 is a sectional view in the sub-scanning direction showing a thermal head according to a fifth embodiment of the present invention.

FIG. 11 is a sectional view in the sub-scanning direction showing a thermal head 20-5 according to a fifth embodiment of the present invention.

Like the thermal head 20-2 according to the second embodiment shown in FIG. 6, the thermal head 20-5 according to the fifth embodiment shown in FIG. 11 includes the partial ridge portion 22*b* and the partial ridge portion 22*c*. However, the convex portion 23*a* and the convex portion 23*b* same as those in the thermal head 20-1 according to the first embodiment shown in FIG. 2 are further formed on the upper sides of the partial ridge portion 22*b* and the partial ridge portion 22*c*.

As in the thermal head 20-1 according to the first embodiment (see FIG. 2), the heat element H1*a* and the heat element H1*b* are arranged near the tops of the convex portion 23*a* and the convex portion 23*b*, respectively. Therefore, positions of the electrode connecting portions C opposed to each other in the sub-scanning direction of the heat element H1*a* and the heat element H1*b* are lower than the highest portions of the heat element H1*a* and the heat element H1*b*. Thus, the edge portion of the protective film 26 between the heat element H1*a* and the heat element H1*b* does not come into contact with the ink ribbon 50 (the recording sheet 40 and the platen roller 30).

In the thermal head 20-5 according to the fifth embodiment, bases of the convex portion 23*a* and the convex portion 23*b* are the partial ridge portion 22*b* and the partial ridge portion 22*c*. Thus, the respective tops of the convex portion 23*a* and the convex portion 23*b* formed at the tops of the partial ridge portion 22*b* and the partial ridge portion 22*c* are in highest positions in the entire thermal head 20-5 and have a substantially horizontal shape over the length in the sub-scanning direction or a gentle curved surface shape symmetrical with respect to the tops. Therefore, "contact" of the heat element H1*a* and the heat element H1*b* is further improved. A glaze 21*d* including the partial ridge portion 22*b* and the partial ridge portion 22*c* on which the convex portion 23*a* and the convex portion 23*b* are formed can be manufactured by, for example, matching a shape of the rotating grindstone blade 82 shown in FIG. 8 to the glaze 21*d*.

Sixth Embodiment

Figure 12:
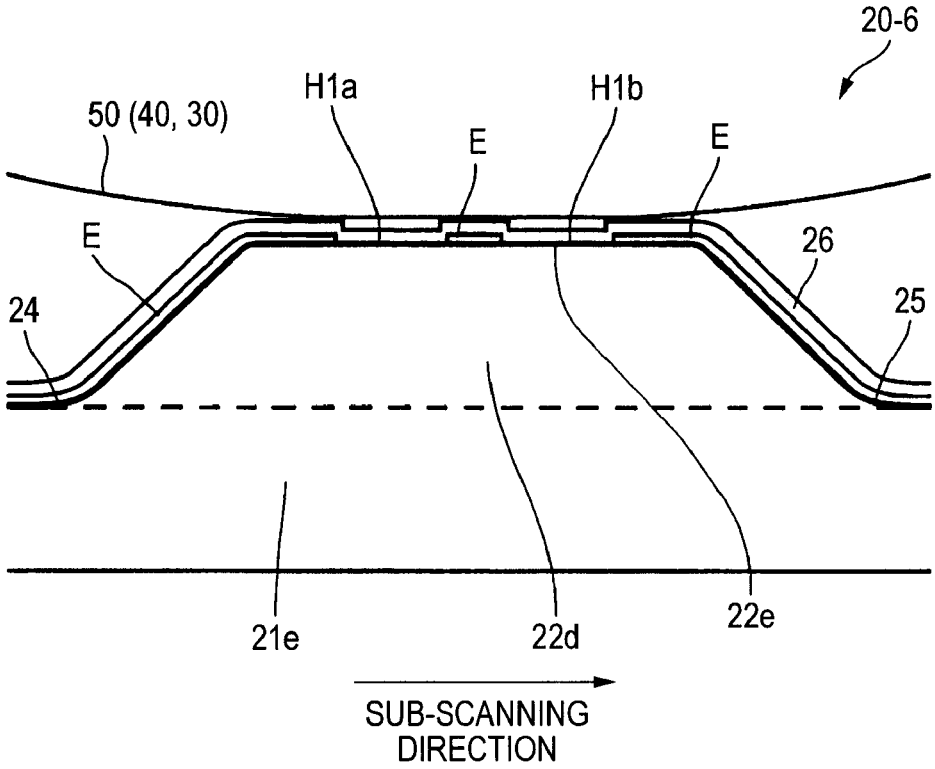
FIG. 12 is a sectional view in the sub-scanning direction showing a thermal head according to a sixth embodiment of the present invention.

FIG. 12 is a sectional view in the sub-scanning direction showing a thermal head 20-6 according to a sixth embodiment of the present invention.

As shown in FIG. 12, a glaze 21*e* in the thermal head 20-6 according to the sixth embodiment includes a ridge portion 22*d* of a ridge shape in a section thereof in the sub-scanning direction and a flat portion 22*e* formed at the top of the ridge portion 22*d*. The heat element H1*a* and the heat element H1*b* are arranged on an upper side of the flat section 22*e*. In the thermal head 20-6 according to the sixth embodiment, each of the heat element row Ha and the heat element row Hb (see FIG. 1) arrayed in plural rows (two rows) in the sub-scanning direction is arranged on the upper side of the flat portion 22*e*.

Figure 23:
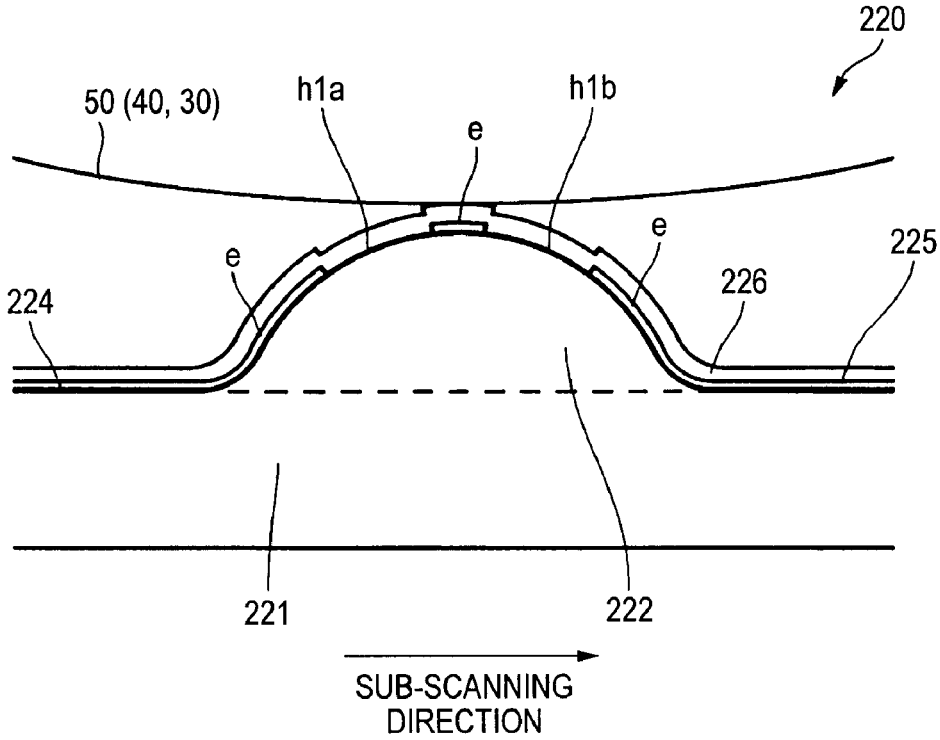
Prior Art FIG. 23
FIG. 23 is a sectional view in the sub-scanning direction showing another thermal head in the past.

As described above, the glaze 21*e* in the thermal head 20-6 according to the sixth embodiment has a trapezoidal shape in the section in the sub-scanning direction. The heat element H1*a* and the heat element H1*b* are arranged on the upper side of the flat portion 22*e*. Therefore, compared with the glaze 22*l* in the thermal head 220 in the past shown in FIG. 23, "contact" of the heat element H1*a* and the heat element H1*b* is improved.

The width of the glaze 21*e* is larger than that of the glaze 22*l*. The section of the glaze 21*e* is not limited to the trapezoidal shape and only has to be formed by the ridge portion 22*d* of a semicircular shape or a gentle ridge shape similar to the semicircular shape and the flat portion 22*e* (a highest portion in the glaze 21*e*) formed by at least partially removing the tops where the heat element H1*a* and the heat element H1*b* are arranged. It is desirable to form a boundary portion of the ridge portion 22*d* and the flat portion 22*e* in an R shape shown in FIG. 12 not to be square.

A method of manufacturing the thermal head 20-6 (the glaze 21*e*) according to the sixth embodiment is explained.

To manufacture the glaze 21*e* of the thermal head 20-6 according to the sixth embodiment, glaze glass formed flat on a substrate of alumina ceramics or the like is etched or otherwise machined to be formed as the ridge portion 22*d* of the ridge shape (the trapezoidal shape) in which the flat portion 22*e* is formed. The glaze glass is subjected to heat treatment at temperature higher than a softening point of glass of the glaze glass. In performing the heat treatment, a heat treatment time is set shorter than that in forming the glass ridge portion 66 of the semicircular shape shown in (c) in FIG. 3 and deformation into an R shape due to reflow is reduced to make corners in an upper part and a lower part of the ridge portion 22*d* smooth while maintaining the flat portion 22*e*. In this way, in manufacturing the glaze 21*e*, it is possible to directly use an apparatus generally used in the past and addition or the like of a special manufacturing apparatus is unnecessary.

Such a glaze 21*e* can also be manufactured by matching a shape of the rotating grindstone blade 82 shown in FIG. 8 to the glaze 21*e*. According to this manufacturing method, the process of deformation into an R shape by heating and reflow is unnecessary. Therefore, there is no factor of fluctuation in a shape due to a change in heat treatment conditions, a temperature distribution of the entire substrate, and the like. It is possible to stably form a shape including the flat portion 22*e*.

Moreover, the step of the protective film 26 is eliminated by polishing as in the thermal head 20-3 according to the third embodiment (see FIG. 9) or eliminated by embedding the aluminum layer 25 in the glaze 21*e* as in the thermal head 20-4 according to the fourth embodiment (see FIG. 10). In this way, it is also possible to further improve "contact" of the heat element H1*a* and the heat element H1*b*.

Seventh Embodiment

Figure 13:
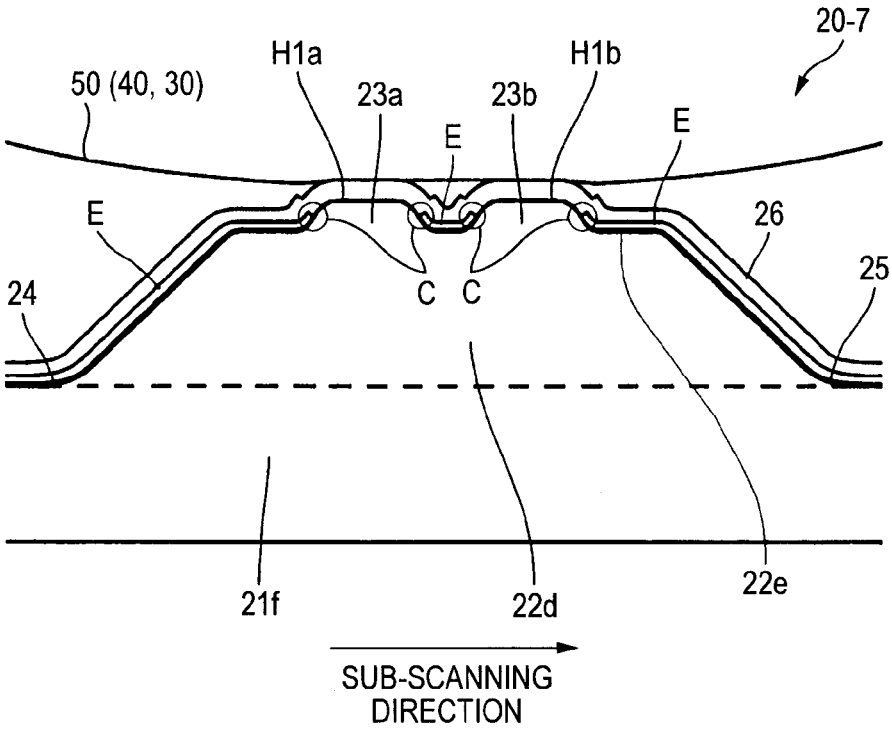
FIG. 13 is a sectional view in the sub-scanning direction showing a thermal head according to a seventh embodiment of the present invention.

FIG. 13 is a sectional view in the sub-scanning direction showing a thermal head 20-7 according to a seventh embodiment of the present invention.

Like the thermal head 20-6 according to the sixth embodiment shown in FIG. 12, the thermal head 20-7 according to the seventh embodiment shown in FIG. 13 includes the ridge portion 22*d* and the flat portion 22*e*. However, the convex portion 23*a* and the convex portion 23*b* same as those in the thermal head 20-1 according to the first embodiment shown in FIG. 2 are further formed on the upper side of the flat portion 22*e*.

As in the thermal head 20-1 (see FIG. 2) according to the first embodiment, the heat element H1*a* and the heat element H1*b* are arranged near the tops of the convex portion 23*a* and the convex portion 23*b*, respectively. Therefore, positions of the electrode connecting portions C opposed to each other in the sub-scanning direction of the heat element H1*a* and the heat element H1*b* are lower than the highest portions of the heat element H1*a* and the heat element H1*b*. Thus, the edge portion of the protective film 26 between the heat element H1*a* and the heat element H1*b* does not come into contact with the ink ribbon 50 (the recording sheet 40 and the platen roller 30).

The respective tops of the convex portion 23*a* and the convex portion 23*b* formed on the upper side of the flat portion 22*e* are in highest positions in the entire thermal head 20-7 and have a substantially horizontal shape over the length in the sub-scanning direction or a gentle curved surface shape symmetrical with respect to the tops. Therefore, "contact" of the heat element H1*a* and the heat element H1*b* is further improved. The "contact" of the heat element H1*a* and the heat element H1*b* is improved because the convex portion 23*a* and the convex portion 23*b* are formed on the upper side of the flat portion 22*e*. In other words, the height of the ridge portion 22*d* hardly affects a quality of "contact". Therefore, it is also possible to set the height of the ride portion 22*d* to "0" (remove the ridge portion 22*d* and directly form the convex portion 23*a* and the convex portion 23*b* on a flat surface).

In the thermal head 20-7 according to the seventh embodiment, the electrode connecting portions C opposed to each other in the sub-scanning direction are in positions lower than the highest portions of the heat element H1*a* and the heat element H1*b*. Therefore, the edge portion (the step) of the protective film 26 between the heat element H1*a* and the heat element H1*b* does not come into contact with the ink ribbon 50 (the recording sheet 40 and the platen roller 30). It is considered unnecessary to remove the step of the protective film 26.

However, the step of the protective film 26 may inevitably occur in an upper part or an inclined portion of the convex portion 23*a* or the convex portion 23*b* when the space between the heat element H1*a* and the heat element H1*b* is reduced or because of, for example, design of the length in the sub-scanning direction of the heat element H1*a* or the heat element H1*b*. Therefore, in such a case, since it is necessary to eliminate the step, it is also possible to eliminate the step of the protective film 26 and improve "contact" of the heat element H1*a* and the heat element H1*b* by adopting the method and the structure explained concerning the thermal head 20-3 according to the third embodiment (see FIG. 9) or the thermal head 20-4 according to the fourth embodiment (see FIG. 10).

A method of manufacturing the thermal head 20-7 (a glaze 21*f*) according to the seventh embodiment is explained.

To manufacture the glaze 21*f* of the thermal head 20-7 according to the seventh embodiment, glaze glass formed flat on a substrate of alumina ceramics or the like is etched or otherwise machined to form the ridge portion 22*d* of the ridge shape (the trapezoidal shape), the flat portion 22*e* at the top of the ridge portion 22*d*, and rectangular portions corresponding to the convex portion 23*a* and the convex portion 23*b* on the flat portion 22*e*. Thereafter, corners of the respective portions are smoothed by heat treatment to obtain the glaze 21*f*.

The glaze 21*f* can also be manufactured by matching a shape of the rotating grindstone blade 82 shown in FIG. 8 to the glaze 21*f*. According to this manufacturing method, it is possible to collectively form a complicated shape including the convex portion 23*a* and the convex portion 23*b* on the flat portion 22*e* of the ridge portion 22*d*. Thus, it is possible to further simplify the process while maintaining shape accuracy.

Moreover, it is also possible to form the ridge portion 22*d*, the flat portion 22*e*, the convex portion 23*a*, and the convex portion 23*b* by first forming a shape obtained by removing a part of a reference shape of a semicircular shape and a gentle ridge shape similar to the semicircular shape in a section thereof along the sub-scanning direction such that at least a portion corresponding to an area in which the heat element H1*a* and the heat element H1*b* are arranged is formed as a flat surface and, then, performing etching and heat treatment. According to this method, even when the convex portion 23*a* and the convex portion 23*b* are fine, it is difficult to match a shape of the rotating grindstone blade 82 to the convex portion 23*a* and the convex portion 23*b*, and it is difficult to collectively machine the portions, it is possible to form the convex portion 23*a* and the convex portion 23*b* by etching and heat treatment (deformation into an R shape) in a short time after the etching. Since the heat treatment is performed in a short time, flatness of the flat portion 22*e* is maintained.

Eighth Embodiment

Figure 14:
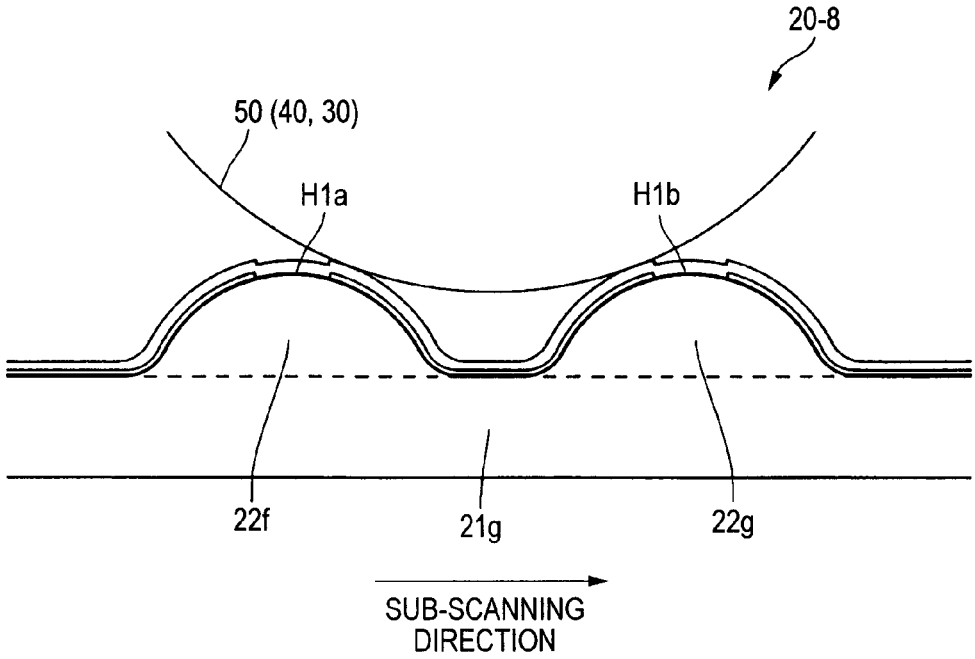
FIG. 14 is a sectional view in the sub-scanning direction showing a thermal head according to an eighth embodiment of the present invention.

FIG. 14 is a sectional view in the sub-scanning direction showing a thermal head 20-8 according to an eighth embodiment of the present invention.

As shown in FIG. 14, a glaze 21*g* in the thermal head 20-8 according to the eighth embodiment includes plural (two) ridge portions 22*f* and 22*g* that are arranged in the sub-scanning direction in association with the number of arrays (two rows) of the heat element row Ha and the heat element row Hb (see FIG. 1) and are a ridge shape in sections thereof in the sub-scanning direction. The heat element H1*a* and the heat element H1*b* are arranged on upper sides of the ridge portion 22*f* and the ridge portion 22*g*.

As described above, in the thermal head 20-8 according to the eighth embodiment, the glaze 21*g* includes the separate ridge portions 22*f* and 22*g*. The sections in the sub-scanning direction of the ridge portion 22*f* and the ridge portion 22*g* are formed in a two-ridge shape of a semicircular shape. The heat element H1*a* and the heat element H1*b* are arranged near the tops of the ridge portion 22*f* and the ridge portion 22*g*. The centers in the sub-scanning direction of the heat element H1*a* and the heat element H1*b* are located at the tops of the ridge portion 22*f* and the ridge portion 22*g*.

Therefore, in the thermal head 20-8 according to the eighth embodiment shown in FIG. 14, while a pressing force on the ink ribbon 50 (the recording sheet 40 and the platen roller 30) is maintained, both the heat element H1*a* and the heat element H1*b* have center positions in the sub-scanning direction near the respective tops of the ridge portion 22*f* and the ridge portion 22*g*. Therefore, "contact" of the ridge portion 22*f* and the ridge portion 22*g* is improved. The ridge portion 22*f* and the ridge portion 22*g* can be formed by etching, cutting or the like by the rotating grind blade 82 (see FIG. 8), and the like.

Ninth Embodiment

Figure 15:
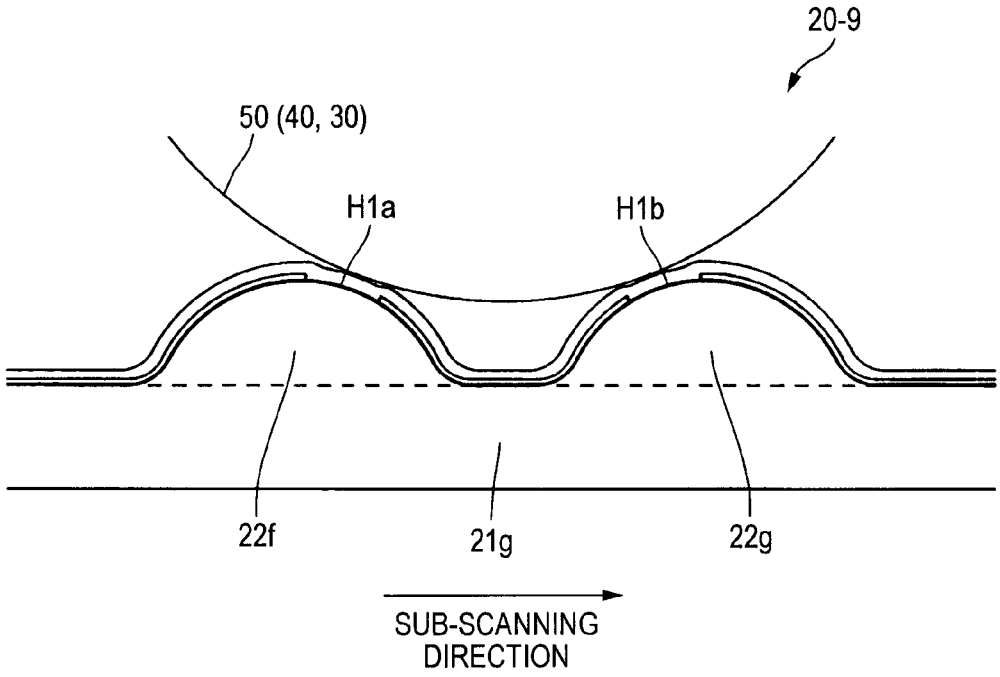
FIG. 15 is a sectional view in the sub-scanning direction showing a thermal head according to a ninth embodiment of the present invention.

FIG. 15 is a sectional view in the sub-scanning direction showing the thermal head 20-9 according to a ninth embodiment of the present invention.

Like the thermal head 20-8 according to the eighth embodiment shown in FIG. 14, the thermal head 20-9 according to the ninth embodiment shown in FIG. 15 includes the ridge portion 22*f* and the ridge portion 22*g*. However, the arrangement of the heat element H1*a* and the heat element 11*b* is shifted closer to the center between the heat elements in the sub-scanning direction than the tops of the ridge portion 22*f* and the ridge portion 22*g*.

The heat element H1*a* and the heat element H1*b* are arranged to be shifted closer to the center between the heat elements to further improve "contact". In other words, when a space between the ridge portion 22*f* and the ridge portion 22*g* increases, contact positions of the ridge portion 22*f* and the ridge portion 22 with an outer circumference of the platen roller 30 shift closer to the center between the ridge portions. Therefore, the heat element H1*a* and the heat element H1*b* are arranged on slop portions slightly down closer to the center between the ridge portion 22*f* and the ridge portion 22*g* from the respective tops of the ridge portions to match the contact positions and "contact" is improved.

Tenth Embodiment

Figure 16:
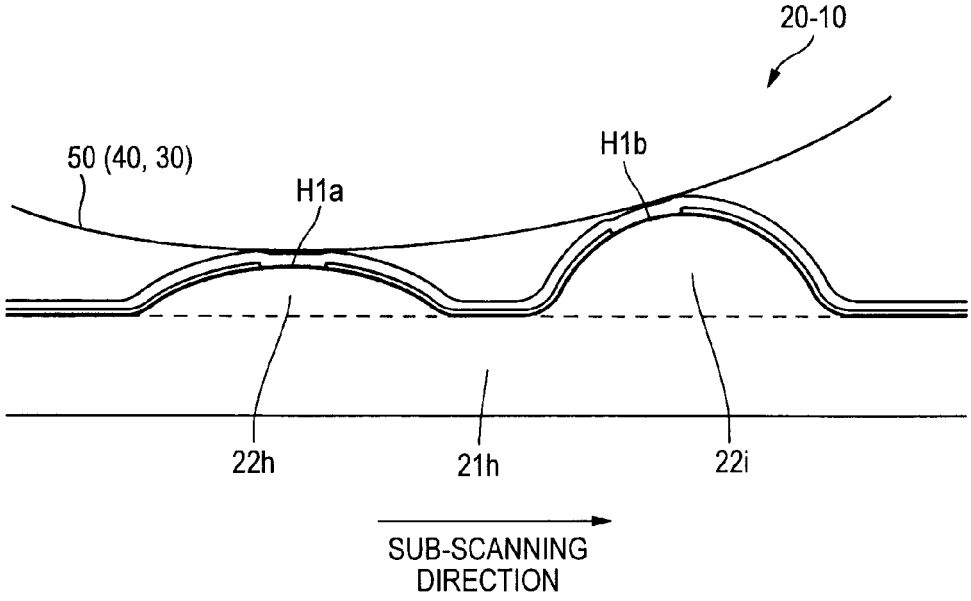
FIG. 16 is a sectional view in the sub-scanning direction showing a thermal head according to a tenth embodiment of the present invention.

FIG. 16 is a sectional view in the sub-scanning direction showing a thermal head 20-10 according to a tenth embodiment of the present invention.

Like the thermal head 20-8 according to the eighth embodiment shown in FIG. 14, the thermal head 20-10 according to the tenth embodiment shown in FIG. 16 has a two-ridge shape. However, a glaze 21*h* includes a low ridge portion 22*h* and a high ridge portion 22*i* having different heights according to an outer diameter of the platen roller 30 opposed to the glaze 21*h*.

The glaze 21*h* has the low ridge portion 22*h* and the high ridge portion 22*i* in this way to improve "contact". In other words, although the low ridge portion 22*h* is formed relatively lower than the high ridge portion 22*i*, the heat element H1*a* is arranged at the top of the low ridge portion 22*h*. On the other hand, the high ridge portion 22*i* is formed relatively higher than the low ridge portion 22*h*. The heat element H1*b* is arranged on a slope portion slightly down closer to the center between the ridge portions from the top. Therefore, since the heat element H1*a* and the heat element H1*b* are arranged in contact positions of the platen roller 30 along the outer circumference of the platen roller 30, "contact" is improved.

Eleventh Embodiment

Figure 17:
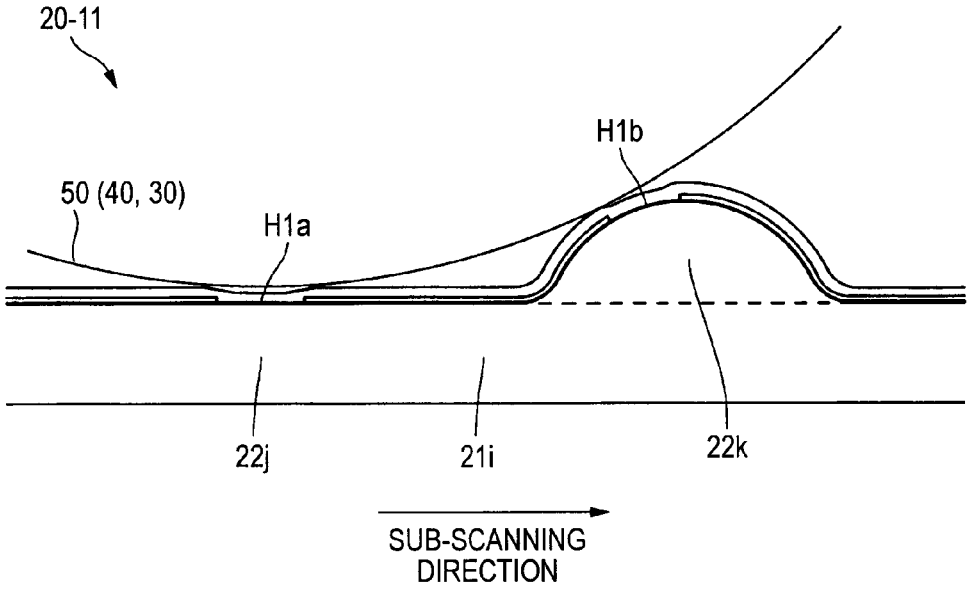
FIG. 17 is a sectional view in the sub-scanning direction showing a thermal head in according to an eleventh embodiment of the present invention.

FIG. 17 is a sectional view in the sub-scanning direction showing a thermal head 20-11 according to an eleventh embodiment of the present invention.

In the thermal head 20-11 according to the eleventh embodiment shown in FIG. 17, the height of the low ridge portion 22*h* in the thermal head 20-10 according to the tenth embodiment shown in FIG. 16 is set to "0". In other word, the low ridge portion 22*h* (see FIG. 16) is removed and a glaze 21*i* including a flat base portion 22*j* and a ridge portion 22*k* is used.

The glaze 21*i* includes the flat base portion 22*j* and the ridge portion 22*k* to improve "contact". In other words, the heat element H1*a* is arranged on an upper side of the base section 22*j* and the heat element H1*b* is arranged on an upper side of the ridge portion 22*k* but on a slope portion slightly down closer to the center between the flat base portion 22*j* and the ridge portion 22*k* from the top of the ridge portion 22*k*.

Therefore, since the heat element H1*a* and the heat element H1*b* are arranged in contact positions of the platen roller 30 along the outer circumference of the platen roller 30, "contact" is improved.

In such a glaze 21*i*, although a pressing force of the platen roller 30 in the base section 22*j* is rather low, only one ridge portion 22*k* is provided. Therefore, the glaze 21*i* is effective for improvement of "contact", in particular, when it is difficult to form the two ridge portions 22*f* and 22*g* (FIG. 14) or when it is possible to form the two ridge portions 22*f* and 22*g* but there is a problem of cost because of a glaze forming process, a manufacturing apparatus, or the like. It is also possible to set a pressing force of the thermal head 20-11 slightly large and increase the sinking of the platen roller 30 to improve "contact".

Twelfth Embodiment

Figure 18:
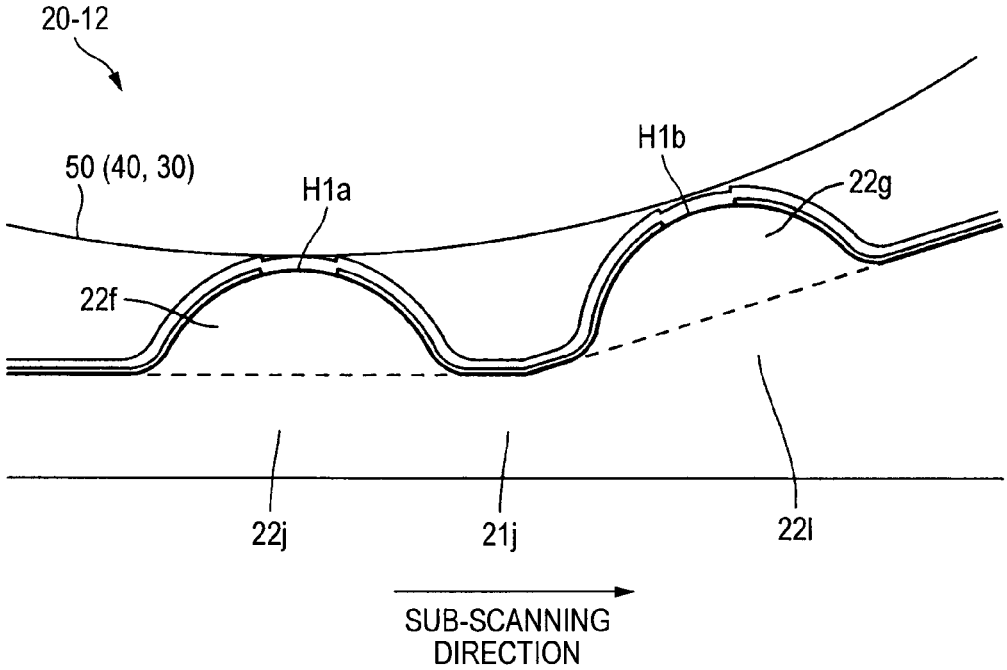
FIG. 18 is a sectional view in the sub-scanning direction showing a thermal head according to a twelfth embodiment of the present invention.

FIG. 18 is a sectional view in the sub-scanning direction showing a thermal head 20-12 according to a twelfth embodiment of the present invention.

The thermal head 20-12 according to the twelfth embodiment shown in FIG. 18 uses a glaze 21*j* including a flat base portion 22*j* and an inclined portion 22*l* inclined according to the outer diameter of the platen roller 30 opposed thereto unlike the glaze 21*g* in the thermal head 20-8 according to the eighth embodiment shown in FIG. 14. The ridge portion 22*f* and the ridge portion 22*g* are separately located on the upper sides of the base portion 22*j* and the inclined portion 22*l*.

The heat element H1*a* and the heat element H1*b* are arranged near the respective tops of the ridge portion 22*f* and the ridge portion 22*g*. The centers in the sub-scanning direction of the heat element H1*a* and the heat element H1*b* are located at the respective tops of the ridge portion 22*f* and the ridge portion 22*g*. However, the ridge portion 22*g* is located on the inclined portion 22*l* inclined according to the outer diameter of the platen roller 30. Therefore, the ridge portion 22*f* and the ridge portion 22*g* are inclined relatively to each other. The heat element H1*a* and the heat element H1*b* are arranged in contact positions of the platen roller 30 along the outer circumference of the platen roller 30. Therefore, "contact" is improved.

The heat element H1*a* and the heat element H1*b* may be arranged on slope portions slightly down closer to the center between the ridge portion 22*f* and the ridge portion 22*g* from the tops of the ridge portions rather than being arranged near the respective tops of the ridge portions. In other words, the centers in the sub-scanning directions of the heat element H1*a* and the heat element H1*b* only have to be located in optimum positions depending on a dimension relation among curvature radiuses and heights of the ridge portion 22*f* and the ridge portion 22*g* of a semicircular shape, a space between the ridge portions, the outer diameter of the platen roller 30, and the like. It is also possible to provide plural inclined portions 22*l* or remove the base portion 22*j* and provide only the plural inclined portions 22*l*.

Thirteenth Embodiment

Figure 19:
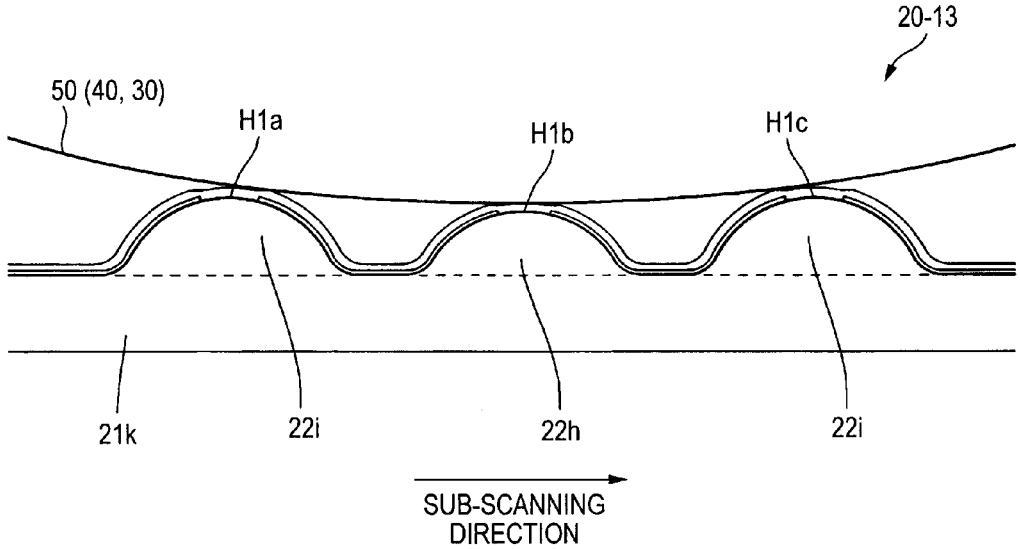
FIG. 19 is a sectional view in the sub-scanning direction showing a thermal head according to a thirteenth embodiment of the present invention.

FIG. 19 is a sectional view in the sub-scanning direction showing a thermal head 20-13 according to a thirteenth embodiment of the present invention.

In the thermal head 20-13 according to the thirteenth embodiment shown in FIG. 19, the number of high ridge portions 22*i* in the thermal head 20-10 according to the tenth embodiment shown in FIG. 16 is increased to two. The high ridge portions 22*i* are combined with the low ridge portion 22*h* to form a three-ridge shape. In other words, when a heat element row Hc is added to the heat element row Ha and the heat element row Hb shown in FIG. 1, since the number of arrays is three, the three ridge portions (the one low ridge portion 22*h* and the two high ridge portions 22*i*) are provided in association with the number of arrays. The heat element H1*a*, the heat element H1*b*, and a heat element H1*c* are arranged in the ridge portions, respectively. In the heat element row Hc, a plurality of the heat elements H1*c* are arrayed in the main scanning direction.

When there are three low ridge portions 22*h*, when there are three high ridge portions 22*i*, or when the heights of all the ridge portions are identical, relatively satisfactory "contact" is obtained in the centers of the ridge portions. However, since the platen roller 30 has a cylindrical shape long in the main scanning direction, "contact" at both ends of the ridge portions is extremely poor. Therefore, in the thermal head 20-13 according to the thirteenth embodiment, the low ridge portion 22*h* is arranged in the center and the high ridge portions 22*i* are arranged on both sides of the low ridge portion 22*h*, respectively, along the outer circumference of the platen roller 30 to improve the "contact". Even when the number of arrays of the heat element rows is increased to be equal to or more than three, ridge portions can be arranged in the same manner.

Fourteenth Embodiment

Figure 20:
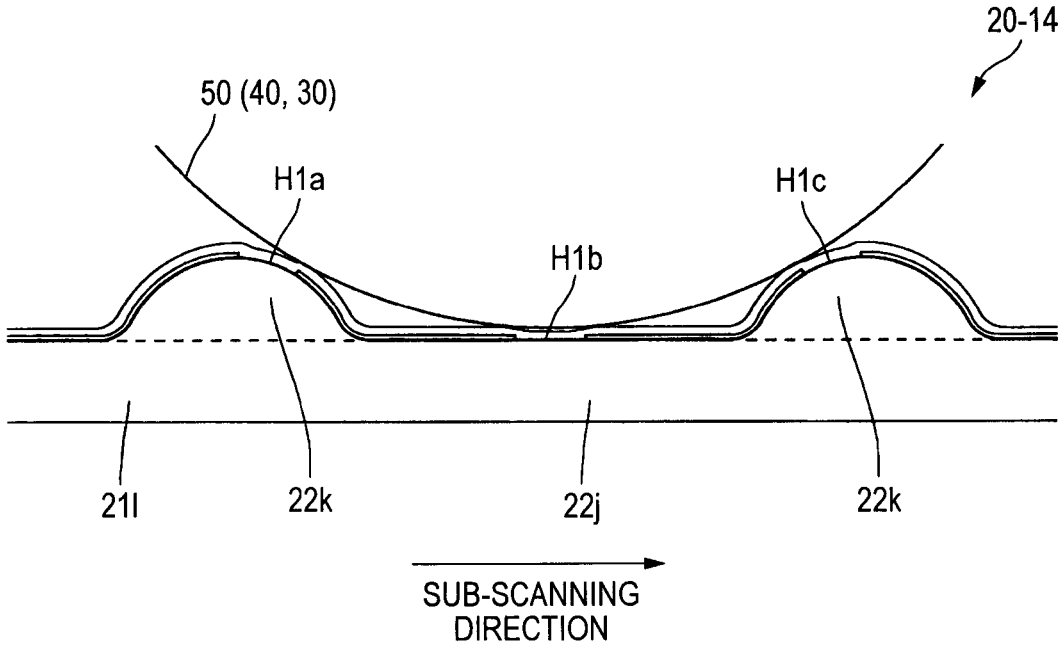
FIG. 20 is a sectional view in the sub-scanning direction showing a thermal head according to a fourteenth embodiment of the present invention.

FIG. 20 is a sectional view in the sub-scanning direction showing a thermal head 20-14 according to a fourteenth embodiment of the present invention.

In the thermal head 20-14 according to the fourteenth embodiment shown in FIG. 20, the height of the low ridge portion 22*h* in the thermal head 20-13 according to the thirteenth embodiment shown in FIG. 19 is set to "0". Alternatively, the number of ridge portions 22*k* in the thermal head 20-11 according to the eleventh embodiment shown in FIG. 17 is increased to two. In other words, in the thermal head 20-14 according to the fourteenth embodiment, the glaze 21*l* including the flat base portion 22*j* and the two ridge portions 22*k* is used.

The glaze 21*l* includes the flat base portion 22*j* and the two ridge portions 22*k* in this way to further improve "contact". The heat element H1*a* and the heat element H1*c* are arranged on the upper sides of the ridge portions 22*k* but on slope portions slightly down closer to the center between the ridge portions from the tops, respectively. The heat element H1*b* is arranged on the upper side of the base portion 22*j*. Therefore, since the heat element H1*a*, the heat element H1*b*, and the heat element H1*c* are arranged in contact positions of the platen roller 30 along the outer circumference of the platen roller 30, "contact" is improved.

In such a glaze 21*l*, the flat base portion 22*j* and the two ridge portions 22*k* are provided along the outer circumference of the platen roller 30 and "contact" is improved in all the heat element H1*a*, the heat element H1*b*, and the heat element H1*c*. Although a pressing force of the paten roller 30 is rather low in the base portion 22*j*, compared with the thermal head 20-13 according to the thirteenth embodiment (see FIG. 19), only the two ridge portions 22*k* having the same height only have to be formed. Therefore, for example, even when it is difficult to form the three ridge portions (the one low ridge portion 22*h* and the two ridge portions 22*i*) shown in FIG. 19 or when it is difficult to form the ridge portions having the different heights (the low ridge portion 22*h* and the high ridge portion 22*i*) because of a glaze forming process, a manufacturing apparatus, or the like, the glaze 21*l* is effective for improvement of "contact" and in terms of cost. It is also possible to set a pressing force of the thermal head 20-14 slightly large and increase the sinking of the platen roller 30 to improve "contact".

Therefore, according to the present invention, the thermal head 20 that has improved "contact" of the respective heat elements H, can perform high-speed recording, and is excellent in a recording quality can be realized. During ultrahigh-speed recording, excessive temperature rise of the thermal head 20 is prevented and further deterioration in the thermal head 20 is suppressed. As a result, it is possible to extend the durable life of the thermal head 20. Since excessive temperature rise of the thermal head 20 during ultrahigh-speed recording is prevented, it is possible to prevent the fall in a recording quality due to occurrence of "tailing" or the like. Moreover, it is possible to realize high definition of a formed image while realizing high-speed recording using the thermal head 20 in which the respective heat elements H are arranged with high density (e.g., 600 DPI). Furthermore, by setting the step of the protective film 26 to be smaller than 0.01 μm, it is possible to prevent the problem of "sticking" and the like while arranging the respective heat elements H with high density (e.g., 600 DPI).

The embodiments of the present invention have been explained. However, the present invention is not limited to the embodiments described above. For example, various modifications described below are possible.

(1) The thermal head 20 can be applied not only to the sublimation transfer system for transferring dye held on the ink ribbon 50 onto the recording sheet 40 to record an image and the like but also to, for example, a heat sensitive type system for recording an image and the like on the recording sheet 40 of a heat sensitive type without using the ink ribbon 50.

(2) The number of arrays of heat element rows is not limited to two or three and the present invention is applied in the same manner regardless of the number of rows in the sub-scanning direction of heat element rows such as the heat element rows Ha, Hb, Hc, and the like. This makes it possible to improve "contact".

It should be understood by those skilled in the art that various modifications, combinations, sub-combinations, and alterations may occur depending on design requirements and other factors insofar as they are within the scope of the appended claims or the equivalents thereof.

What is claimed is:

1. A thermal head comprising:

a plurality of heat generating element rows in which plural heat generating elements are arrayed in a main scanning direction; and a glaze that stores heat generated from the heat generating elements, wherein, the thermal head is configured to record an image on a recording medium by causing the respective heat generating elements to generate heat while the recording medium is conveyed in a sub-scanning direction, the plurality of the heat generating element rows are arrayed in the sub-scanning direction, the glaze includes a ridge portion extending in the main scanning direction, the heat generating element rows being arrayed on the ridge portion, the glaze includes a plurality of convex portions on the ridge portion, the convex portions are arrayed in the sub-scanning direction, the convex portions are formed on an outer sides of the ridge portions respectively, and the heat generating elements are arranged on outer sides of the convex portions, respectively.

2. A thermal head according to claim 1, wherein the ridge portion is semicircular in section in the scanning direction.

3. A thermal head according to claim 1, wherein the ridge portion is trapezoidal in section in the scanning direction.

4. A thermal head according to claim 1, wherein:

each heating element has electrode connecting portions at opposite ends thereof; and along at least one section, two heating elements are coupled in series with the electrode connection portions between them being in a portion of the ridge that is lower than the outermost surfaces of the convex portions.

5. A thermal head according to claim 4, wherein at least the respective electrode connecting portions are embedded in the glaze.

6. A thermal head comprising:

a plurality of heat generating element rows in which plural heat generating elements are arrayed in a main scanning direction; and a glaze that stores heat generated from the heat generating elements, wherein, the thermal head is configured to record an image on a recording medium by causing the respective heat generating elements to generate heat while the recording medium is conveyed past the thermal head in a sub-scanning direction the plurality of the heat generating element rows are arrayed in the sub-scanning direction, the glaze includes a ridge on which at least two heat generating element rows are arrayed, the ridge is trapezoidal in shape in section, and the heat generating element rows are arrayed on a flat surface of the ridge.

7. A thermal head comprising:

a plurality of heat generating element rows in which plural heat generating elements are arrayed in a main scanning direction; and a glaze that stores heat generated from the heat generating elements, wherein, the thermal head is configured to record an image on a recording medium by causing the respective heat generating elements to generate heat while the recording medium is conveyed past the thermal head in a sub-scanning direction, the plurality of the heat generating element rows are arrayed in the sub-scanning direction, the glaze includes a ridge portion in a section thereof in the sub-scanning direction with a flat portion formed at a top of the ridge portion, and the heat generating elements are arranged on an upper side of the flat portion.

8. A thermal head comprising:

two heat generating element rows in which plural heat generating elements are arrayed in a main scanning direction; and a glaze that stores heat generated from the respective heat generating elements, wherein, the thermal head is configured to record an image on a recording medium by causing the respective heat generating elements to generate heat while the recording medium is conveyed past the thermal head in a sub-scanning direction, the plurality of the heat generating element rows are arrayed in the sub-scanning direction, the glaze includes two ridge portions extending in the scanning direction and arrayed in the sub-scanning direction in association with a number of arrays of the heat generating element rows, each ridge portion having a center line with respect to the section thereof, the heat generating elements are arranged on upper sides of the ridge portions, respectively, and each heat generating element row is positioned on a side of the center line of its ridge portion closest to the other heat generating element row.

9. A thermal head comprising:

two heat generating element rows in which plural heat generating elements are arrayed in a main scanning direction; and a glaze that stores heat generated from the respective heat generating elements, wherein, the thermal head is configured to record an image on a recording medium by causing the respective heat generating elements to generate heat while the recording medium is conveyed past the thermal head in a sub-scanning direction, the plurality of the heat generating element rows are arrayed in the sub-scanning direction, the glaze includes two ridge portions extending in the scanning direction and arrayed in the sub-scanning direction in association with a number of arrays of the heat generating element rows, and the heat generating elements are arranged on upper sides of the ridge portions, respectively the respective ridge portions have different heights according to an outer diameter of a platen roller opposed to the ridge portions.

10. A thermal head comprising:

two heat generating element rows in which plural heat generating elements are arrayed in a main scanning direction; and a glaze that stores heat generated from the respective heat generating elements, wherein, the thermal head is configured to record an image on a recording medium by causing the respective heat generating elements to generate heat while the recording medium is conveyed past the thermal head in a sub-scanning direction, the plurality of the heat generating element rows are arrayed in the sub-scanning direction, the glaze includes two ridge portions extending in the scanning direction and arrayed in the sub-scanning direction in association with a number of arrays of the heat generating element rows, and the glaze has a flat base portion and an inclined portion inclined according to an outer diameter of a platen roller opposed to the glaze, and the two ridge portions are located on respective upper sides of the base portion and the inclined portion.

11. A thermal head comprising:

a plurality of heat generating element rows in which plural heat generating elements are arrayed in a main scanning direction; and a glaze that stores heat generated from the respective heat generating elements, wherein, the thermal head is configured to record an image on a recording medium by causing the respective heat generating elements to generate heat while the recording medium is conveyed past the thermal head in a sub-scanning direction, the plurality of the heat generating element rows are arrayed in the sub-scanning direction, the glaze includes a flat base portion and a ridge portion extending in the scanning direction with the flat base portion and the ridge portion arrayed in the sub-scanning direction, and the heat generating element rows are respectively arranged on upper sides of the base portion and the ridge portion.

12. A thermal head comprising:

three heat generating element rows in which plural heat generating elements are arrayed in a main scanning direction; and a glaze that stores heat generated from the respective heat generating elements, wherein, the thermal head is configured to recorded an image on a recording medium by causing the respective heat generating elements to generate heat while the recording medium is conveyed past the thermal head in a sub-scanning direction, the three heat generating element rows are arrayed in the sub-scanning direction, the glaze includes two ridge portions extending in the scanning direction and arrayed in the sub-scanning direction, two the heat generating element rows are positioned on upper sides of the ridge portions, respectively, the glaze includes flat base portion between the two ridge portions, and the third heat generating element row is positioned on the flat base portion.

* * * * *